US006677925B1

(12) United States Patent
Kawaguchi et al.

(10) Patent No.: US 6,677,925 B1
(45) Date of Patent: Jan. 13, 2004

(54) ACTIVE-MATRIX-TYPE LIQUID CRYSTAL DISPLAY DEVICE, DATA SIGNAL LINE DRIVING CIRCUIT, AND LIQUID CRYSTAL DISPLAY DEVICE DRIVING METHOD

(75) Inventors: Takafumi Kawaguchi, Taki-gun (JP); Toshihiro Yanagi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 304 days.

(21) Appl. No.: 09/656,007

(22) Filed: Sep. 6, 2000

(30) Foreign Application Priority Data

Sep. 6, 1999 (JP) ..... 11-252225
Aug. 11, 2000 (JP) ..... 2000-245198

(51) Int. Cl.[7] ..... G09G 3/36; G09G 3/18; G09G 3/20

(52) U.S. Cl. ..... 345/98; 345/55; 345/90

(58) Field of Search ..... 345/51, 52, 58, 345/55, 87, 98, 92, 90

(56) References Cited

U.S. PATENT DOCUMENTS 5,434,599 A * 7/1995 Hirai et al. ..... 345/100
5,745,090 A * 4/1998 Kim et al. ..... 345/90
5,748,171 A * 5/1998 Ishizaki et al. ..... 345/101
5,818,402 A * 10/1998 Park et al. ..... 345/100
6,222,516 B1 * 4/2001 Oda et al. ..... 345/100
6,259,425 B1 * 7/2001 Shimizu ..... 345/100

FOREIGN PATENT DOCUMENTS

JP 2960268/1999 7/1999

* cited by examiner

*Primary Examiner*—Steven Saras
*Assistant Examiner*—Alecia D. Nelson
(74) *Attorney, Agent, or Firm*—David G. Conlin; William J. Daley, Jr.; Edwards & Angell, LLP

(57) ABSTRACT

In an active-matrix LCD device, a coupling signal in accordance with a sum of outputs of data signal lines is detected by a detection-use bus line crossing each of the data signal lines. The coupling signal is superimposed via a coupling capacitor on an input signal that serves as a reference, and is inverted and amplified by a inverting-amplifying section, then it is outputted as a common electrode signal. With this, a waveform that corresponds to a sum of the outputs is coupled with the common electrode signal. As a result, the common electrode signal is caused to have an influence that corresponds to a fluctuation of a potential of the common electrode due to outputs of the data signal lines and that is reverse in phase, thereby enabling to prevent horizontal shadow due to the outputs of the data signal lines. Thus, it is possible to realize an active-matrix-type LCD device in which horizontal shadow can be prevented with low power consumption.

22 Claims, 16 Drawing Sheets

ACTIVE-MATRIX-TYPE LIQUID CRYSTAL DISPLAY DEVICE, DATA SIGNAL LINE DRIVING CIRCUIT, AND LIQUID CRYSTAL DISPLAY DEVICE DRIVING METHOD

FIELD OF THE INVENTION

The present invention relates to an active-matrix-type liquid crystal display device, such as a thin-film-transistor (TFT) liquid crystal display device, a data signal line driving circuit, and a liquid crystal display device driving method.

BACKGROUND OF THE INVENTION

Recently, liquid crystal display (LCD) devices have rapidly become in common use since consumed power is small and the size can be easily reduced, as compared with CRT (cathode-ray-tube) display devices. Among such LCD devices, active-matrix-type LCD devices that are characterized by quicker response and easier multiple-gray-level display are widely used.

In a conventional active-matrix-type LCD device 101 as above, for example, as shown in FIG. 13, when a scanning signal line driving circuit 104 selects a scanning signal line $GL_j$, field-effect transistors SW shown in FIG. 2 provide conduction at pixels PIX connected with the scanning signal line $GL_j$, thereby connecting the pixels $PIX_{(i,j)}$ with data signal lines $SL_i$ corresponding to the pixels. On the other hand, a data signal line driving circuit 103 outputs display data D to data signal lines $SL_1$ through $SL_n$ based on video signals DAT so that the display data D are to be fed to the pixels PIX. Charges corresponding to respective differences between outputs of the data signal lines $SL_1$ through $SL_n$ and a common electrode potential Vcom are stored in pixel capacitors $C_P$ of the pixels PIX. At pixels PIX connected with the scanning signal lines GL that are not selected, switching elements SW thereof are opened, thereby holding charges in pixel capacitors $C_P$ thereof. Incidentally, transmittance of liquid crystal elements varies with a voltage applied. Therefore, while consecutively selecting the scanning signal lines $GL_1$ through $GL_m$, the display data D are written in a pixel $PIX_{(i,j)}$ during a selection period of each scanning signal line $GL_j$. By so doing, the LCD device 101 causes an image according to the foregoing video signal DAT to be displayed on the liquid crystal panel 102.

In the foregoing active-matrix-type LCD device 101, the data signal line $SL_i$ and the pixel capacitor $C_P$ are separated while the scanning signal line $GL_i$ is not selected, and a voltage according to the display data D that have been written in the pixel capacitor $C_P$ upon selection is continuously applied to the liquid crystal element. Therefore, as compared with a simple-matrix-type LCD device, the multiple-gray-level display can be relatively easily realized.

The foregoing arrangement, however, undergoes a problem such that, to realize a higher-definition active-matrix-type LCD device with a larger display screen particularly, horizontal shadow more easily occurs, impairing image quality.

More specifically, taking the case where polarities of outputs of the data signal lines $SL_1$ through $SL_n$ are reversed every horizontal scanning period, current flows to charge/discharge a capacitor between a source of each field-effect transistor SW and a common electrode $T_{com}$ every horizontal scanning period. Note that examples of such capacitors include, apart from the foregoing pixel capacitors $C_P$, capacitors formed between the data signal lines $SL_1$ through $SL_n$ and the common electrodes $T_{com}$, cross capacitors formed between the data signal lines $SL_1$ through $SL_n$ and bus lines, and cross capacitors formed between the data signal lines $SL_1$ through $SL_n$ and the scanning signal lines $GL_1$ through $GL_m$.

Here, current charging/discharging the foregoing capacitors varies with output amplitudes of the data signal lines $SL_1$ through $SL_n$. Therefore, in the case where resistances between supplementary capacitors $C_S$ of the pixel capacitors $C_P$, common transfer resistances, output impedance of a common electrode driving circuit 105, etc. cause resistance components to exist in the common electrode line COM connected with the common electrodes $T_{com}$ and $C_S$ bus lines connected with the supplementary capacitors $C_S$, a voltage fall due to the foregoing resistance components varies with the output amplitudes of the data signal lines $SL_1$ through $SL_n$. Consequently, a rising speed of a common electrode potential Vcom waveform varies with a display pattern that varies every horizontal scanning period.

For example, as shown in FIG. 14, comparing a portion A in which all the data signal lines $SL_1$ through $SL_n$ output a white level during one horizontal scanning period with a portion B that includes an output of a black level with a greater potential difference than that of the white level with respect to the common electrode potential Vcom, current flowing at a root part of the common electrode line COM and root parts of the $C_S$ bus lines is greater in the portion B than in the portion A. Therefore, the rising of the common electrode potential Vcom waveform is duller in the portion B as indicated by a broken line than in the portion A as indicated by a solid line in FIG. 15.

Here, in the case where the charging period for the pixel capacitors $C_P$ is sufficient, charging voltage levels to the pixel capacitors $C_P$ are equal to each other in the portions A and B. In the case where, however, for example, the charging to the pixel capacitors $C_P$ is not completed during the charging period due to insufficient driving capacity or operating speed of the field-effect transistors SW, charges less than the value indicated by the display data D are provided to each pixel capacitor $C_P$, and are maintained during a non-selection period as well. In this case, charging becomes insufficient in the portion B rather than in the portion A. Consequently, the brightness of a white part of the portion B becomes higher than the brightness of a white part of the portion A, resulting in that white horizontal shadow occurs. Incidentally, the explanation herein is made by using a normally-white-type LCD device, but the same applies in the case of a normally-black-type LCD device.

The foregoing horizontal shadow can be prevented by reducing the resistance components of the $C_S$ bus lines and the common electrode line COM and by ensuring sufficient charging period for charging the pixel capacitors $C_P$. However, there are limits to reduction of the resistance components and improvement of characteristics of the field-effect transistors SW, while higher-definition LCD devices with larger display screens are demanded. Enlargement of the display screen will require longer $C_S$ bus lines and common electrode line COM, thereby making it difficult to reduce the resistance components. Besides, in a high-definition LCD device, data signal lines $SL_1$ through $SL_n$ and the scanning signal lines $GL_1$ through $GL_m$ increase in number, making it difficult to ensure sufficient charging time. Therefore, in such LCD devices in particular, horizontal shadow more often occur, and elimination of horizontal shadow is demanded.

Incidentally, the U.S. Pat. No. 2,960,268 (Date of Publication: Jul. 8, 1994) discloses an active-matrix liquid crystal panel including capacity-coupled sensing electrodes that cross data signal lines $SL_1$ through $SL_n$ with an insulating film provided between the same and the data signal lines $SL_1$ through $SL_n$, and an inverter for applying to the common electrode a voltage that corresponds to a potential fluctuation occurring to the sensing electrode and that is obtained by reversing a polarity of the potential fluctuation. This arrangement is aimed to cancelling the potential fluctuation occurring to the common electrode with the voltage applied to the data signal lines $SL_1$ through $SL_n$, so as to prevent occurrence of horizontal shadow. In the present arrangement however, application of the output signal of the inverter to the common electrode for driving the common electrode makes AC driving impossible, and causes the power consumed by the whole LCD device to drastically increase. On the other hand, as described above, it is preferable that power used for removing horizontal shadow is small, since the LCD devices are often used in fields where reduction of power consumption is demanded as described above.

SUMMARY OF THE INVENTION

An object of the present invention is to provide an active-matrix-type liquid crystal display device capable of preventing horizontal shadow with lower power consumption.

To achieve the foregoing object, an active-matrix-type LCD device of the present invention includes (i) a coupling section for generating a coupling signal in accordance with a sum of the outputs, based on outputs to the data signal lines, and (ii) a common electrode driving circuit for, based on the coupling signal and the driving signal as a reference used in generation of the common electrode signal, generating the common electrode signal that is given an influence such as to suppress potential turbulence caused by an output to each data signal line, by comparing the common electrode signal with a common electrode generated according to only the driving signal.

According to the foregoing arrangement, based on outputs to the data signal lines, a coupling signal is generated in accordance with a sum of the outputs, and a common electrode signal is generated based on the coupling signal and the driving signal. This enables to apply to the common electrode of each pixel an influence that corresponds to a fluctuation of a potential of the common electrode due to the outputs of the data signal lines and that is in a direction opposite to that of the fluctuation, with electric power lower than that in the case where the foregoing coupling signal is directly applied to the common electrodes. Besides, the same voltage waveform can be applied to the common electrode of each pixel, irrespective of display patterns. Furthermore, since the common electrode driving circuit generates the common electrode signal based on the coupling signal and the driving signal, the driving capacity and output range of the coupling section can be suppressed, as compared with the case where the foregoing coupling signal is directly applied to the common electrodes. Therefore, the power consumption can be lowered, and even in the case where a sufficient time for charging the pixel capacitors cannot be secured, horizontal shadow can be prevented.

Furthermore, to achieve the aforementioned object, an active-matrix-type LCD device in accordance with another preferable embodiment of the present invention includes (i) a coupling section for generating a coupling signal in accordance with a sum of the outputs of the data signal lines by the switching cycles of the outputs, according to the display data, and (ii) a common electrode driving circuit for, based on the coupling signal and the driving signal as a reference used in generation of the common electrode signal, generating the common electrode signal that is given an influence such as to suppress potential turbulence caused by an output to each data signal line, by comparing the common electrode signal with a common electrode generated according to only the driving signal.

According to the foregoing arrangement, based on display data for generation of outputs to the data signal lines, the coupling section generates a coupling signal in accordance with a sum of the outputs, while the common electrode driving circuit generates a common electrode signal based on the coupling signal and the driving signal. Therefore, as in the case where the common electrode signal is generated based on the outputs of the data signal lines, this provides reduction of power consumption and prevention of horizontal shadow even in the case where a sufficient time for charging the pixel capacitors cannot be secured.

Furthermore, since a sum of the outputs is obtained not only according to the outputs of the data signal lines but according to the display data, horizontal shadow can be prevented without changing the arrangement of the data signal line driving circuit and the liquid crystal panel.

Furthermore, in each of the foregoing arrangements, the coupling section may preferably include a coupling circuit for coupling the driving signal with the coupling signal, and the common electrode driving circuit amplifies the driving signal coupled with the coupling signal, so as to generate the common electrode signal.

In the foregoing arrangement, the driving signal is amplified by the common electrode driving circuit after the coupling operation of the coupling signal by the coupling circuit, thereby becoming the common electrode signal. As a result, in spite of a relatively simple arrangement in which a coupling circuit is added to the arrangement for generating a common electrode signal by amplifying the driving signal, the common electrode signal, which is generated using the driving signal as a reference, can be controlled according to the coupling signal.

Furthermore, in the foregoing arrangement, the coupling circuit is preferably a coupling capacitor. With this arrangement, since the coupling operation of the coupling signal is carried out by the coupling capacitor, which is a passive element, the power consumption of the LCD device can be suppressed as compared with the case where the coupling operation is carried out by an active element.

Furthermore, in the foregoing arrangement, the driving signal is preferably applied to the common electrode driving means via a resistor, and a time constant according to the coupling capacitor and the resistor is set so that an extent of coupling between the coupling signal and the driving signal should have a predetermined value. With this arrangement in which the extent of coupling is set according to the time constant according to the coupling capacitor and the resistor, the common electrode signal can be controlled in accordance with the coupling signal, in spite of the simplicity of the arrangement that does not utilize a high-performance operational amplifying element.

Additionally, in the foregoing arrangement, the LCD device preferably further includes adjusting circuit for adjusting at least either a resistance of the resistor or a capacitance of the coupling capacitor. This arrangement allows each of LCD devices to, by means of its own adjusting means, adjust the extent of coupling according to a magnitude of shadow occurring thereto, so that the shadow can be prevented. Consequently, even in the case where the LCD devices too greatly vary, it is possible to make the LCD devices capable of preventing occurrence of horizontal shadow.

On the other hand, a method for driving an active-matrix-type liquid crystal display device in accordance with the present invention is characterized in that the common electrode signal is dulled as a potential difference between the common electrode signal and a sum of outputs of the data signal lines becomes smaller by the switching cycles of the output signals.

Therefore, an influence that corresponds to a fluctuation of a potential of the common electrodes caused by outputs of the data signal lines and that is in a direction opposite to that of the fluctuation can be given by the common electrode signal. As a result, irrespective of display pattern, a voltage waveform dulled in the same manner is applied to the common electrode of each pixel. Consequently, even in the case where a sufficient period for charging the pixel capacitors cannot be secured, the occurrence of horizontal shadow can be prevented with low power consumption.

For a fuller understanding of the nature and advantages of the invention, reference should be made to the ensuing detailed description taken in conjunction with the accompanying drawings.

DESCRIPTION OF THE PREFERRED EMBODIMENTS

[First Embodiment]

Figure 1:
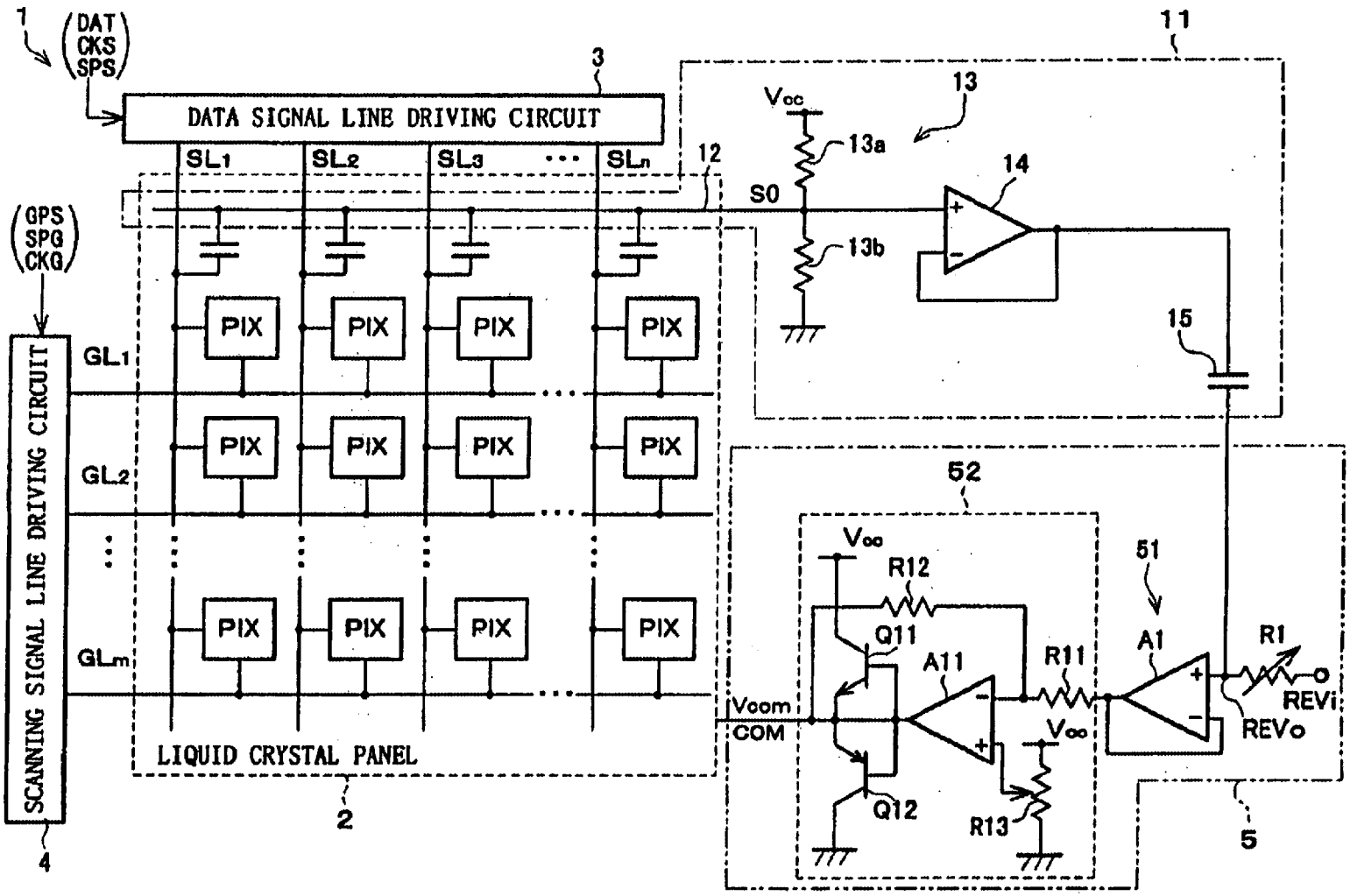
FIG. 1 illustrates one embodiment of the present invention: it is a circuit diagram illustrating a principal part of an LCD device.

The following description will explain an embodiment of the present invention, while referring to FIGS. 1 through 11 and FIG. 16. As shown in FIG. 1, an LCD device 1 in accordance with the present embodiment is provided with a liquid crystal panel 2 having pixels PIX arranged in matrix, a data signal line driving circuit (data signal line driving means) 3 and a scanning signal line driving circuit 4 for driving the pixels PIX, thereby being capable of displaying an image in accordance with a video signal DAT indicating respective display states of the pixels PIX.

The foregoing liquid crystal panel 2 is provided with n data signal lines $SL_1$ through $SL_n$, and m scanning signal lines $GL_1$ through $GL_m$ that cross the data signal lines $SL_1$ through $SL_n$. Let a certain integer not greater than n and a certain integer not greater than m be i and j, respectively, and a pixel $PIX_{(i,j)}$ is provided at each combination of the data signal line $SL_i$ and the scanning signal line $GL_j$. Each pixel $PIX_{(i,j)}$ is provided at a portion defined by two adjacent data signal lines $SL_i$ and $SL_{i+1}$ and two adjacent scanning signal lines $GL_j$ and $GL_{j+1}$.

Figure 2:
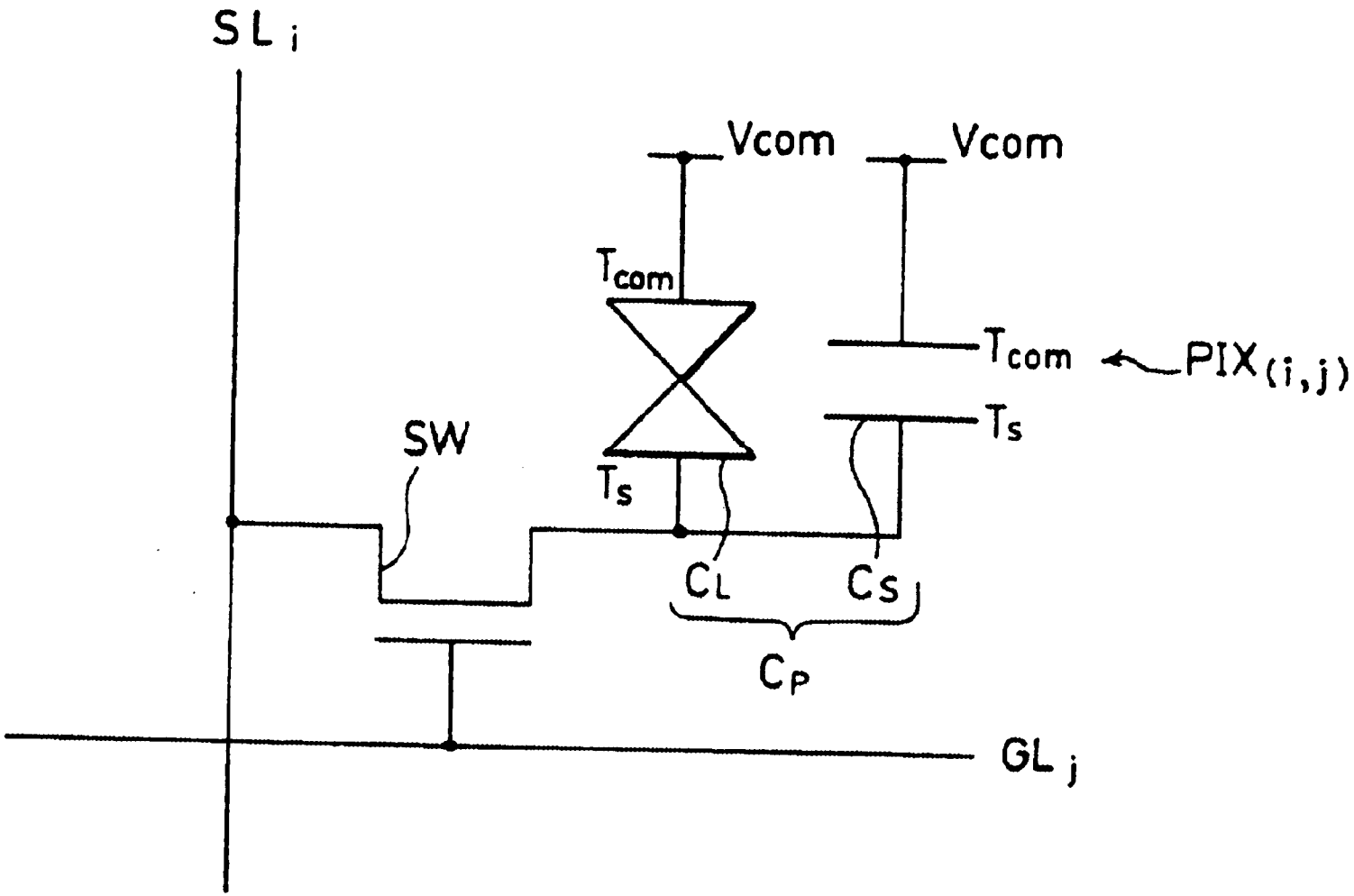
FIG. 2 is a circuit diagram illustrating a structure of a pixel in the foregoing LCD device.

Here, as shown in FIG. 2, the foregoing pixel PIX (i,j) is, for example, equipped with (i) a field-effect transistor (switching element) SW whose gate and source are connected to the scanning signal line $GL_j$ and the data signal line $SL_i$, respectively, and (ii) a pixel capacitor $C_P$ whose electrode (pixel electrode $T_S$) is connected to a drain of the field-effect transistor SW. The other electrode (common electrode $T_{com}$) of the pixel capacitor $C_P$ is a common electrode $T_{com}$ that is common to all the pixels PIX and is actuated by a common electrode driving circuit (common electrode driving means) 5. The foregoing pixel capacitor $C_P$ is composed of a liquid crystal capacitor $C_L$ and a supplementary capacitor $C_S$ that is added as required. In the case where the supplementary capacitor $C_S$ is provided and a signal line ($C_S$ bus line) connected to an electrode, among those of the supplementary capacitor $C_S$, that is not connected with the field-effect transistor SW is drawn out of the liquid crystal panel 2, the common electrode driving circuit 5 applies to the $C_S$ bus line a potential Vcom equal to that for the common electrode $T_{com}$.

When the scanning signal line $GL_j$ is selected at the pixel $PIX_{(i,j)}$, the field-effect transistor SW provides conduction, thereby causing charges according to a difference (voltage) between a potential applied by the data signal line $SL_i$ and a potential Vcom applied to the common electrode $T_{com}$ to be stored in the pixel capacitor $C_P$. On the other hand, while the field-effect transistor SW is opened after the selection period for the scanning signal line $GL_j$ ends, the pixel capacitor $C_P$ continuously keeps a voltage applied when the field-effect transistor became opened. Here, transmittance or reflectance of liquid crystal varies according to a voltage applied to a liquid crystal capacitor $C_L$. Therefore, by selecting the scanning signal line $GL_j$ and applying a voltage according to display data D to the data signal line $SL_i$, the display state of the pixel $PIX_{(i,j)}$ can be made to vary with the display data D.

Here, the LCD device 1 in accordance with the present embodiment adopts, for example, the 1H reverse driving method that reverses the polarity of the common electrode potential Vcom every horizontal scanning period. Therefore, the common electrode driving circuit 5 shown in FIG. 1 reverses the polarity every one horizontal scanning period, and generally applies a "H"- or "L"-level potential to the common electrode line COM. This allows an output range of the data signal line driving circuit 3 upon alternate current driving of liquid crystal to be narrowed as compared with the case where the common electrode potential Vcom is constant and the data signal line driving circuit 3 outputs both the potential with a positive polarity and the potential with a negative polarity, thereby ensuring reduction of power consumption by the LCD device 1.

For example, the common electrode driving circuit 5 generates a common electrode potential Vcom by inverting and amplifying a signal (driving signal) REVi as a reference in alternate current driving. The signal REVi is supplied via a resistor R1 to a voltage follower circuit 51 composed of an operational amplifier A1 and the like. Then, in an inverting-amplifying section (amplifying means) 52, an output of the voltage follower circuit 51 is applied via a resistor R11 to an inversion input terminal of an operational amplifier A11. An output of the operational amplifier A11 is amplified by a push-pull amplifying circuit composed of a pnp-type transistor Q11 and an npn-type transistor Q12, and is applied to the common electrode line COM. Further, a resistor R12 is provided between the foregoing inversion input terminal and the common electrode line COM, and a DC bias voltage is applied to a non-inversion input terminal of the operational amplifier A11. Note that the DC bias voltage is generated by dividing a power source voltage Vcc by a resistor R13.

Incidentally, in the LCD device 1 shown in FIG. 1, the scanning signal line $GL_j$ is selected by the scanning signal line driving circuit 4, and display data D for pixels $PIX_{(i,j)}$ corresponding to respective combinations of the selected scanning signal line $GL_j$ and the selected data signal lines $SL_i$ are supplied to the data signal lines $SL_1$ through $SL_n$, respectively by the data signal line driving circuit 3. On the other hand, the common electrode driving circuit 5 actuates the common electrode line COM according to the foregoing signal REVi and a coupling signal S0 that will be described later. Through this process, the pixels $PIX_{(1,j)}$ through $PIX_{(n,j)}$ that are connected with the scanning signal line $GL_j$ are supplied with respective corresponding display data D. Furthermore, the scanning signal line driving circuit 4 selects the scanning signal lines GL consecutively one by one, and the data signal line driving circuit 3 supplies display data D to the data signal lines $SL_1$ through $SL_n$. Consequently, display data D are written in all the pixels PIX of the liquid crystal panel 2, thereby causing a picture to be displayed on the liquid crystal panel 2.

In addition to the foregoing arrangement, in the LCD device 1 in accordance with the present embodiment, a coupling section 11 is provided. In the coupling section 11, a coupling signal SO in a waveform in accordance with a sum of outputs of all the data signal lines $SL_1$ through $SL_n$ is detected by a detection-use bus line 12, and is applied to a non-inversion input terminal of an operational amplifier A1 of the foregoing voltage follower circuit 51 via a bias circuit 13, a buffer circuit (buffer means) 14, and a coupling capacitor (coupling means) 15 at a level of, for example, 2000 pF. This causes the coupling signal S0 to be coupled in a reversed phase with the common electrode potential Vcom, thereby causing an influence that is equivalent in magnitude and reverse in phase to the influences from the data signal lines $SL_1$ through $SL_n$ to be applied to the common electrode line COM and the $C_S$ bus lines. Consequently, irrespective of display pattern, a voltage waveform dulled in the same manner is applied to the respective common electrodes $T_{com}$ of the pixel $PIX_{(i,j)}$. Therefore, even in the case where a charging period is insufficient, influences to charges stored in the respective pixel capacitors $C_P$ are equal, irrespective of display patterns. Thus, generation of horizontal shadow can be prevented.

More specifically, the detection-use bus line 12 is provided in the liquid crystal panel 2 in accordance with the present embodiment, so as to cross all the data signal lines $SL_1$ through $SL_n$. In this state, the detection-use bus lines 12 are capacity-coupled with all the signal lines $SL_1$ through $SL_n$, and therefore, a potential (coupling signal S0) of the detection-use bus line 12 varies with a sum of outputs of all the data signal lines $SL_1$ through $SL_n$. On the other hand, an end of the detection-use bus line 12 is connected with a power source voltage Vcc via a resistor 13*a* and grounded through a resistor 13*b* in the bias circuit 13. The resistors 13*a* and 13*b* have relatively high resistances of, for example, 1 MΩ, thereby causing a potential of an end of the detection-use bus line 12 to be biased to half of the power source voltage Vcc (power source center). Furthermore, an output of the bias circuit 13 is buffered by the foregoing buffer circuit 14, and thereafter it is superimposed on the signal REVi through the coupling capacitor 15, and is inputted as a signal REVo to the operational amplifier A1 of the voltage follower circuit 51. Here, in the present embodiment, the voltage follower circuit 51 and the inverting-amplifying section 52 of the common electrode driving circuit 5 invert and amplify the signal REVi. Therefore, when the foregoing coupling signal S0 is applied to the common electrode line COM, the signal S0 is coupled, in a polarity opposite to that of the coupling signal S0, with the common electrode potential Vcom.

Furthermore, the resistance of the foregoing resistor R1 and the capacitance of the coupling capacitor 15 are set so that the dullness of the signal REVo with respect to the signal REVi varies according to the coupling signal S0 while an identical dull voltage waveform is applied to each common electrode $T_{com}$ irrespective of a display pattern. Here, in order to adjust the dullness of the waveform by adjusting a rising speed and a falling speed of the common electrode potential Vcom by means of operational amplifying elements, high-speed operational amplifying elements with great driving capacity need be combined. Therefore, there is a possibility that the power consumption of the LCD device increases thereby making the circuit arrangement complex. In the present embodiment, however, an extent of coupling between the coupling signal S0 (output signal of the buffer circuit 14) and the foregoing signal REVi is set to a desired value according to a time constant determined by the foregoing resistance and capacitance. Therefore, in spite of a simple arrangement with low power consumption, the waveform of the common electrode potential Vcom can be dulled according to the coupling signal S0.

Figure 3:
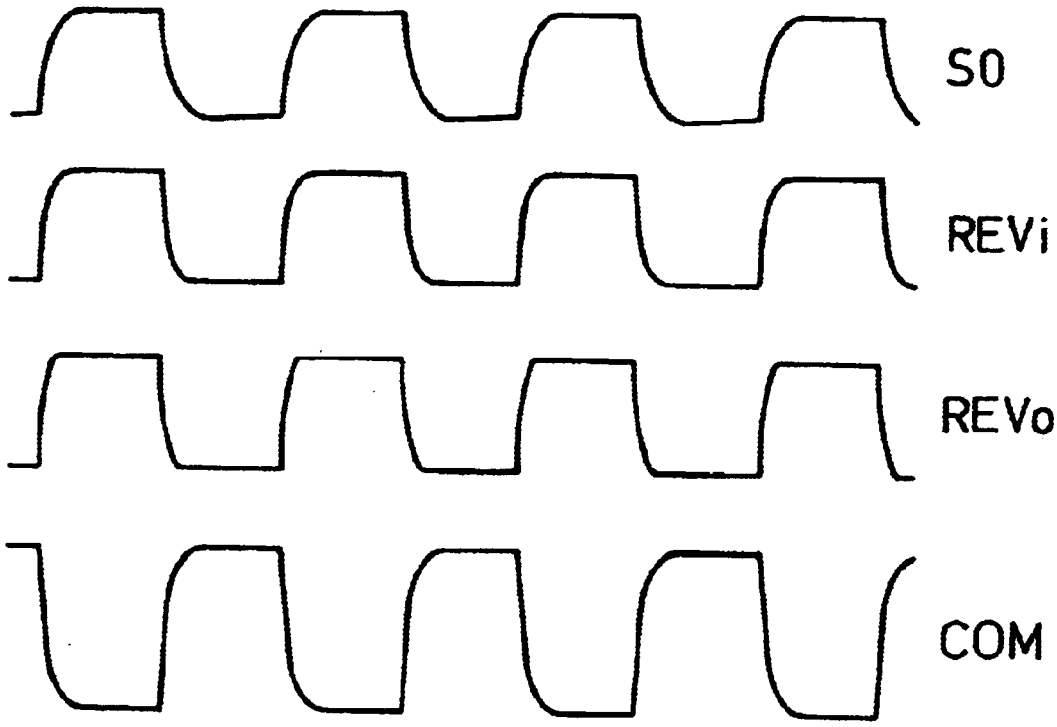
FIG. 3 illustrates an operation of the foregoing LCD device: it is a waveform chart for black display.

With the foregoing arrangement, in the case where the black display accounts for more than a half, that is, in the case where more than a half of the data signal lines $SL_1$ through $SL_n$ output signals having a polarity opposite to that of the common electrode potential Vcom, the coupling signal S0 comes to have a polarity opposite to that of the common electrode potential Vcom as shown in FIG. 3 (an amplitude of the signal is determined in accordance with the sum of the outputs of the data signal lines $SL_1$ through $SL_n$). Therefore, a rising edge of the signal REVo as a base signal for the common electrode potential Vcom becomes less duller, and the falling edge of the common electrode potential Vcom becomes less duller. Likewise, the falling edge of the signal REVo and the rising edge of the common electrode potential Vcom become less duller in the case of black display.

Figure 4:
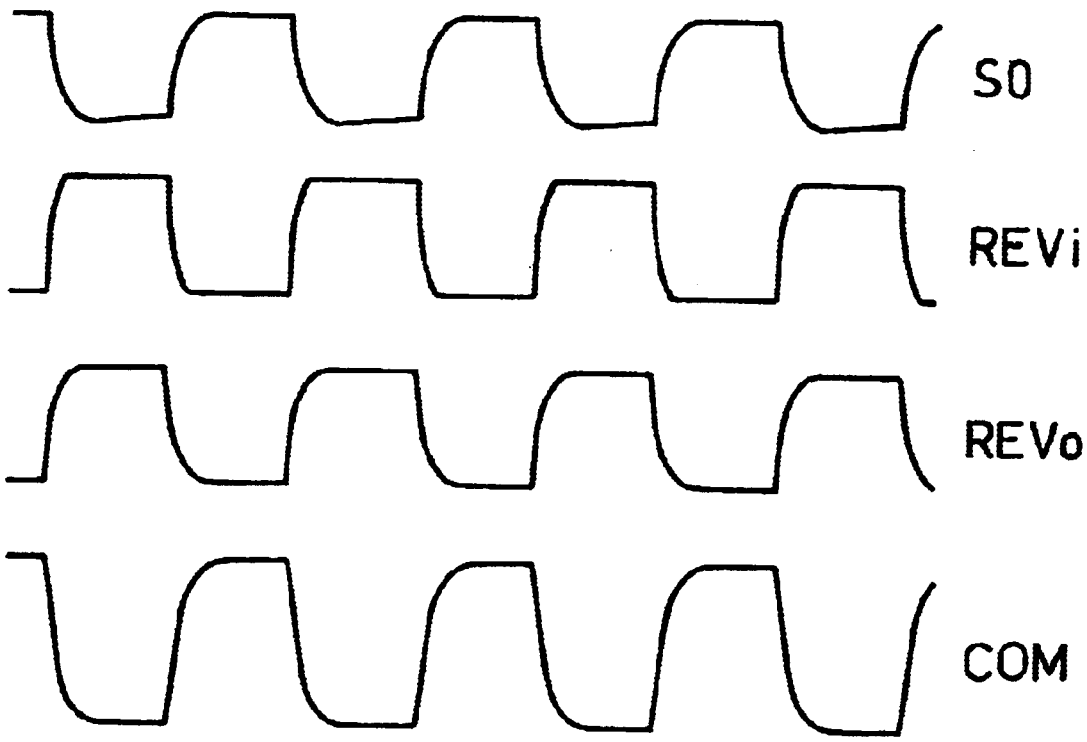
FIG. 4 illustrates an operation of the foregoing LCD device: it is a waveform chart for white display.

Conversely, in the case where the white display accounts for more than a half, that is, in the case where more than a half of the data signal lines $SL_1$ through $SL_n$ output signals having that same polarity as that of the common electrode potential Vcom, the coupling signal S0 comes to have the same polarity as that of the common electrode potential Vcom as shown in FIG. 4 (the amplitude of the signal is determined in accordance with the sum of the outputs of the data signal lines $SL_1$ through $SL_n$). Therefore, a rising edge of the signal REVo becomes much duller, thereby causing the rising edge of the common electrode potential Vcom to become much duller. Likewise, the falling edge of the signal REVo and the rising edge of the common electrode potential Vcom become much duller in the case of white display, as compared with black display. Incidentally, for conveniences' sake, the coupling signal S0 is shown as a potential on the buffer-circuit-14-side electrode of the coupling capacitor 15, in FIGS. 3 and 4.

Figure 15:
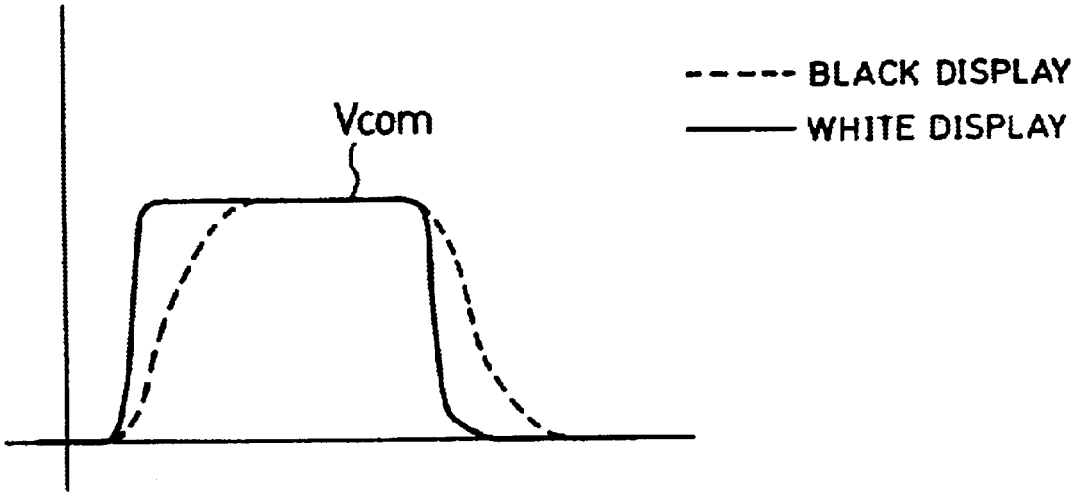
FIG. 15 is a waveform chart illustrating an operation of the foregoing LCD device.

Here, if the coupling signal S0 is not superimposed thereon, the common electrode potential Vcom of the common electrode $T_{com}$ tends to become greatly dull as more of the data signal lines $SL_1$ through $SL_n$ provide black display in the liquid crystal panel 2, as shown in FIG. 15.

In the present embodiment, however, with the coupling signal S0 superimposed on the common electrode potential Vcom, an influence that is equivalent in magnitude and reverse in phase to that applied from the data signal lines $SL_1$ through $SL_n$ is applied to the common electrodes $T_{com}$. Consequently, voltage waveform fluctuations of the common electrodes $T_{com}$ caused by the outputs of the data signal lines $SL_1$ through $SL_n$ are cancelled, ensuring prevention of horizontal shadow.

Consequently, in the case where, for example, the liquid crystal panel 2 is large in size thereby making it difficult to sufficiently lower a resistance of the common electrode resistor, or in the case where the liquid crystal panel 2 is a high-definition panel and a sufficient charging time for the pixel capacitor $C_P$ cannot be ensured, horizontal shadow can be prevented without any problems, and a LCD device 1 providing high image quality can be realized even in the case where it is large in size and provides high-definition.

Furthermore, the foregoing detection-use bus line 12 can be produced in, for example, a line-gate layer upon formation of the scanning signal lines $GL_1$ through $GL_m$, the $C_S$ bus line, or preliminary lines. Therefore, the detection-use bus line 12 can be formed only by changing the pattern of the line-gate layer, without adding a process for forming the detection-use bus line 12 particularly.

Incidentally, the detection-use bus line 12 may be provided at any position as long as it crosses the data signal lines $SL_1$ through $SL_n$, but it is preferably located far from, for example, a backlight, and a circuit generating much noise such as a driving circuit of the backlight. Furthermore, the detection-use bus line 12 is preferably sealed from the foregoing circuits, by employing, for example, ITO (indium tin oxide) electrodes. This enables to reduce noise that would mix in the detection-use bus line 12, thereby enabling more precise detection of the coupling signal S0, and surer prevention of horizontal shadow.

Figure 5:
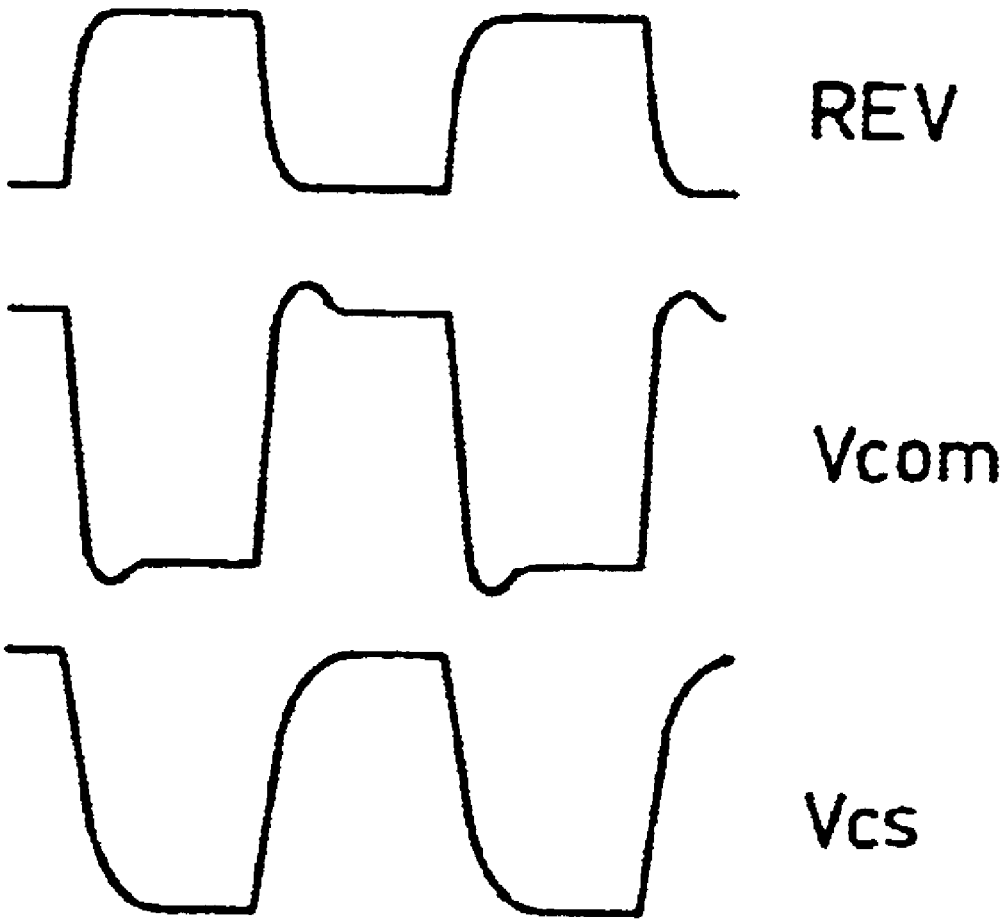
FIG. 5 illustrates an operation of an LCD device of a comparative example with respect to the present invention: it is a waveform chart illustrating an operation in the case where the common electrode signal is overshot.

Here, the present embodiment is compared with a comparative example that is arranged as follows: a small resistor is inserted in a feedback line for feeding back an output of the operational amplifier, a driving waveform of the common electrode potential Vcom and a driving waveform of the supplementary capacitor $C_S$ are taken out before and after the small resistor, and a varying portion of either the driving waveform of the common electrode potential Vcom or the driving waveform of the supplementary capacitor $C_S$ is overshot or undershot according to a load. In the foregoing arrangement, for example, as shown in FIG. 5, the driving waveform Vcom of the common electrode $T_{com}$ or the driving waveform Vcs of the supplementary capacitor $C_S$ is overshot or undershot during black display, so that fluctuations of the potential of the common electrode $T_{com}$ should be cancelled, thereby ensuring prevention of horizontal shadow.

Figure 6:
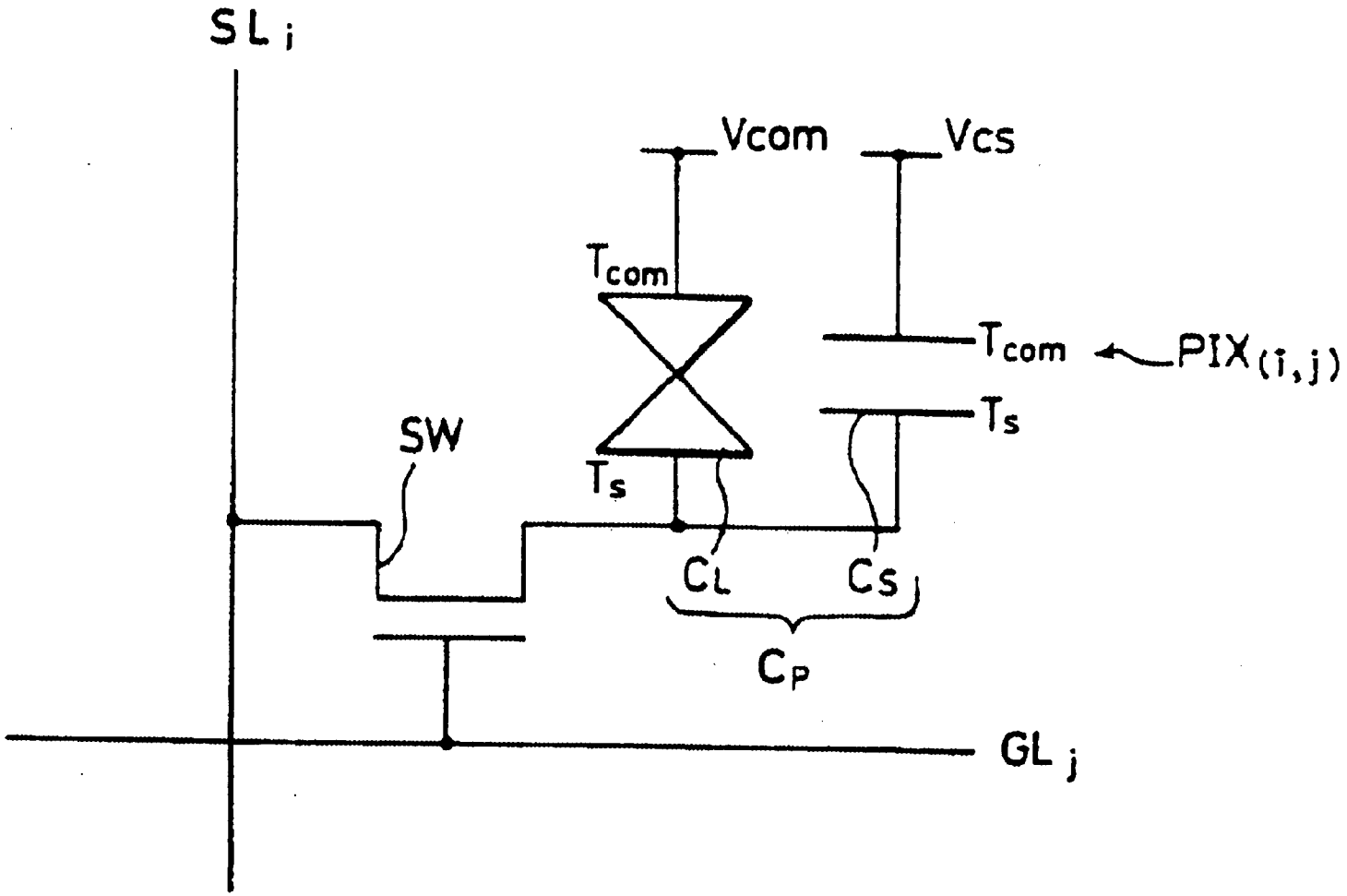
FIG. 6 is a circuit diagram illustrating a structure of a pixel in the foregoing comparative example.
Figure 7:
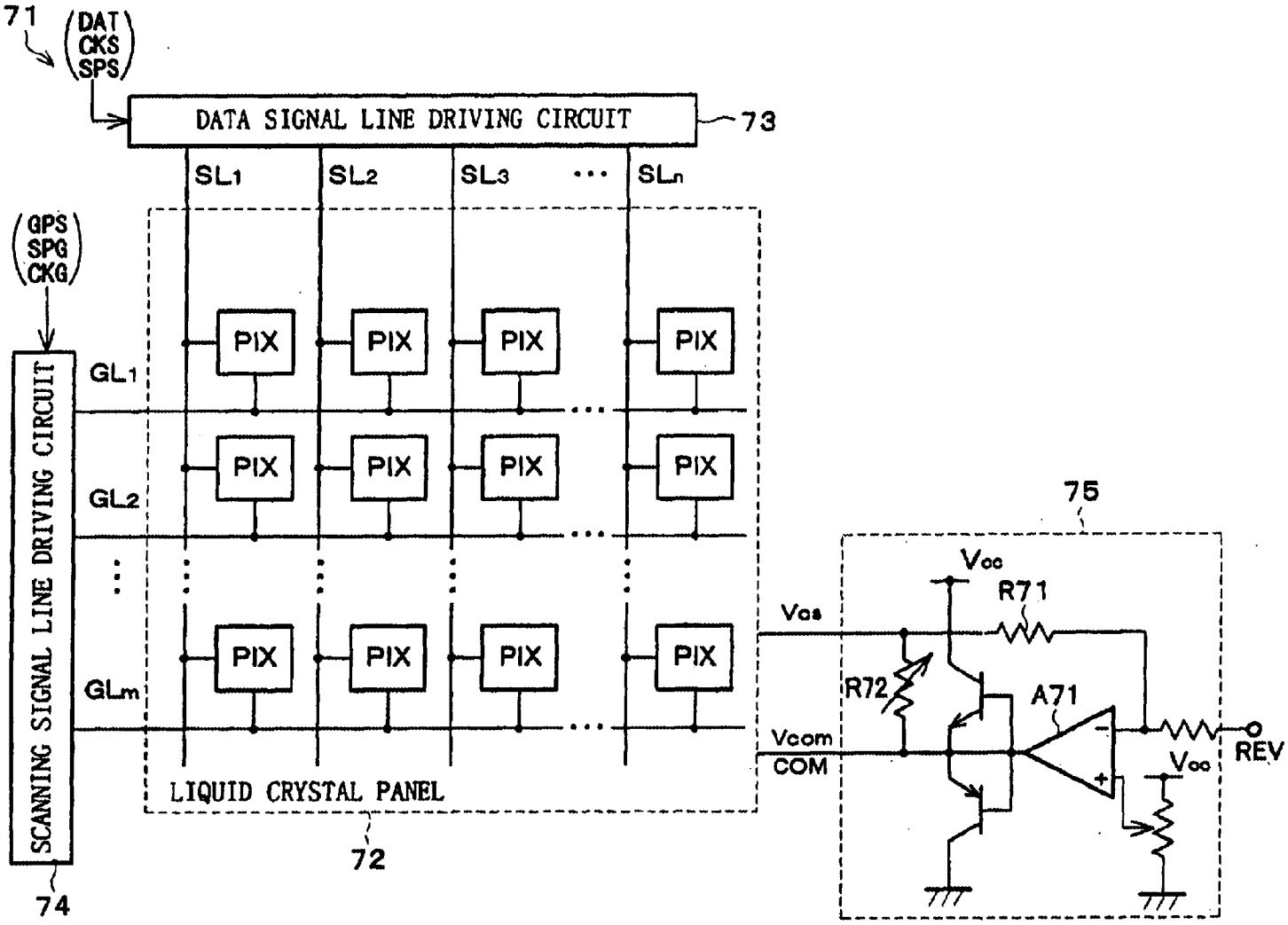
FIG. 7 is a circuit diagram illustrating a principal part of the LCD device in accordance with the foregoing comparative example.

More specifically, as shown in FIG. 6, the non-drain-side electrode ($T_{com}$) of the pixel capacitor $C_P$ and the non-drain-side electrode of the supplementary capacitor $C_S$ are fed with driving signals Vcom and Vcs different from each other, respectively. The driving signal Vcs is obtained as follows: for example, in an LCD device 71 as shown in FIG. 7, a small resistor R72 as well as a resistor R71 are provided in a feedback line for feeding back the output of an operational amplifier A71, and a potential at a point of connection of the small resistor R72 and the resistor R71 is taken out as the driving signal Vcs, when the common electrode driving circuit 75 generates a driving signal Vcom by inverting and amplifying a referential signal REV.

In the foregoing arrangement, however, either the driving waveform Vcom or the driving waveform Vcs is forcibly subjected to a process for cancellation of horizontal shadow, and therefore, there is possibility that horizontal shadow remains, in some display patterns. Besides, a power source voltage range for a driving circuit, for example, an operational amplifier, need be widened for overshooting (undershooting), and current consumed increases as an overshot (undershot) quantity increases. Consequently, current consumed by the LCD device 71 drastically increases, as compared with the case where horizontal shadow is not prevented. Moreover, this arrangement is applicable only to the liquid crystal panel 72 in which the driving signal Vcom of the common electrode $T_{com}$ and the driving signal Vcs of the supplementary capacitor $C_S$ are separated.

On the contrary, the LCD device 1 in accordance with the present embodiment is arranged so that a waveform of a sum of outputs of all the data signal lines $SL_1$ through $SL_n$ is coupled in a reversed phase with the common electrode potential Vcom, thereby causing the common electrode potential Vcom during white display to become duller than that during black display. This enables to cancel fluctuations of a potential of the common electrodes $T_{com}$ due to the data signal lines $SL_1$ through $SL_n$. Therefore, an output range of the common electrode driving circuit 5 can be narrowed, and the power consumption can be reduced, as compared with the foregoing comparative example.

Furthermore, in the case of overshooting or undershooting, there is a possibility that vertical shadow occurs if an overshot or undershot quantity is increased, but in the present embodiment, though horizontal shadow can be prevented, vertical shadow does not occur since the common electrode potential Vcom is dulled.

Here, in another comparative example in which the common electrode potential Vcom is treated by the common electrode driving circuit 5 so that detected fluctuations of the common electrode potential Vcom are cancelled, or in other words, the common electrode potential Vcom is subjected to feedback control, an actual voltage is corrected. Therefore, an amplitude of the common electrode potential Vcom need be quickly increased or decreased in a direction such that the increase or decrease of the actual voltage should be cancelled. Therefore, the common electrode driving circuit 5 tends to consume more electric power since a power source voltage range need be set broader than that of the actual voltage and the response speed of the feedback circuit need be set sufficiently high. Additionally, the gain and phase need be set so that the feedback circuit would not oscillate.

On the contrary, in the present embodiment, the common electrode potential Vcom is made dull according to outputs of the data signal lines $SL_1$ through $SL_n$. Therefore, it is unnecessary to treat the common electrode potential Vcom for increase/decrease of the voltage amplitude, and horizontal shadow can be prevented even in the case where response speeds of the bias circuit 13 and the buffer circuit 14 are set lower than that of the foregoing feedback circuit. Consequently, the power consumed by the LCD device 1 can be reduced, while the foregoing arrangement for preventing oscillation is unnecessary.

Furthermore, in the present embodiment, the coupling signal S0 is coupled with the signal REVi having a smaller amplitude than that of the common electrode potential Vcom on the input side to the inverting-amplifying section 52 and the voltage follower circuit 51. Therefore, as compared with the case where it is coupled directly with the common electrode potential Vcom, an amplitude of an output of the buffer circuit 14 can be set smaller since the coupling is executed before amplification, thereby ensuring decrease of consumed power.

Furthermore, since the foregoing coupling signal S0 is coupled with the coupling capacitor 15 as a passive element, the circuitry structure can be simplified while consumed power can be reduced, as compared with the case where the coupling is realized by employing an active element such as an operational amplifier. Furthermore, an arrangement in which coupling is realized with use of an active element requires a greater driving power due to high-speed actions, and this leads to an increase in the consumed power. In a circuit in which coupling is realized with use of a passive element, conversely, an increase in the consumed power can be prevented, even in the case where the cycle for switching outputs of the data signal lines $SL_1$ through $SL_n$ is short as in the LCD device 1 of high definition.

Furthermore, in the present embodiment, an extent of coupling of the coupling signal S0 with the driving signal REVi is set so that a time constant determined according to a capacitance of the foregoing capacitor 15 and a resistance of the resistor R1 that the signal REVi passes should has a desired value, the extent of coupling can be relatively easily set to a desired value.

More specifically, in a comparative example in which the coupling signal S0 is coupled through a coupling capacitor on an output side of the foregoing common electrode driving circuit 5, in the case where a resistor is inserted in an output line of the common electrode driving circuit 5 so as to adjust an extent of coupling, the resistor causes an input impedance to the common electrode $T_{com}$ to increase, thereby causing horizontal shadow to become more remarkable. Incidentally, to adjust the extent of coupling by adjusting only the capacitance of the coupling capacitor so as to suppress the increase of impedance, a coupling capacitor with a greater capacitance need be provided, and this makes the adjustment to a desired value difficult.

Conversely, in the present embodiment, the coupling signal S0 is coupled at a stage of the driving signal REVi before the common electrode driving circuit 5 (on an input side of the inverting amplifier 52 and the voltage follower circuit 51). Therefore, even with an increase in the impedance due to the resistor R1 inserted at the stage of the driving signal REVi, the input impedance to the common electrode $T_{com}$ can be maintained to an extremely small level without causing a change in the waveform, by the processing by amplifiers such as the inverting amplifying section 52 and the voltage follower circuit 51. Consequently, the extent of coupling can be adjusted with the resistance and with the capacitance both, without an increase in the input impedance that would then cause an increase in horizontal shadow.

Figure 8:
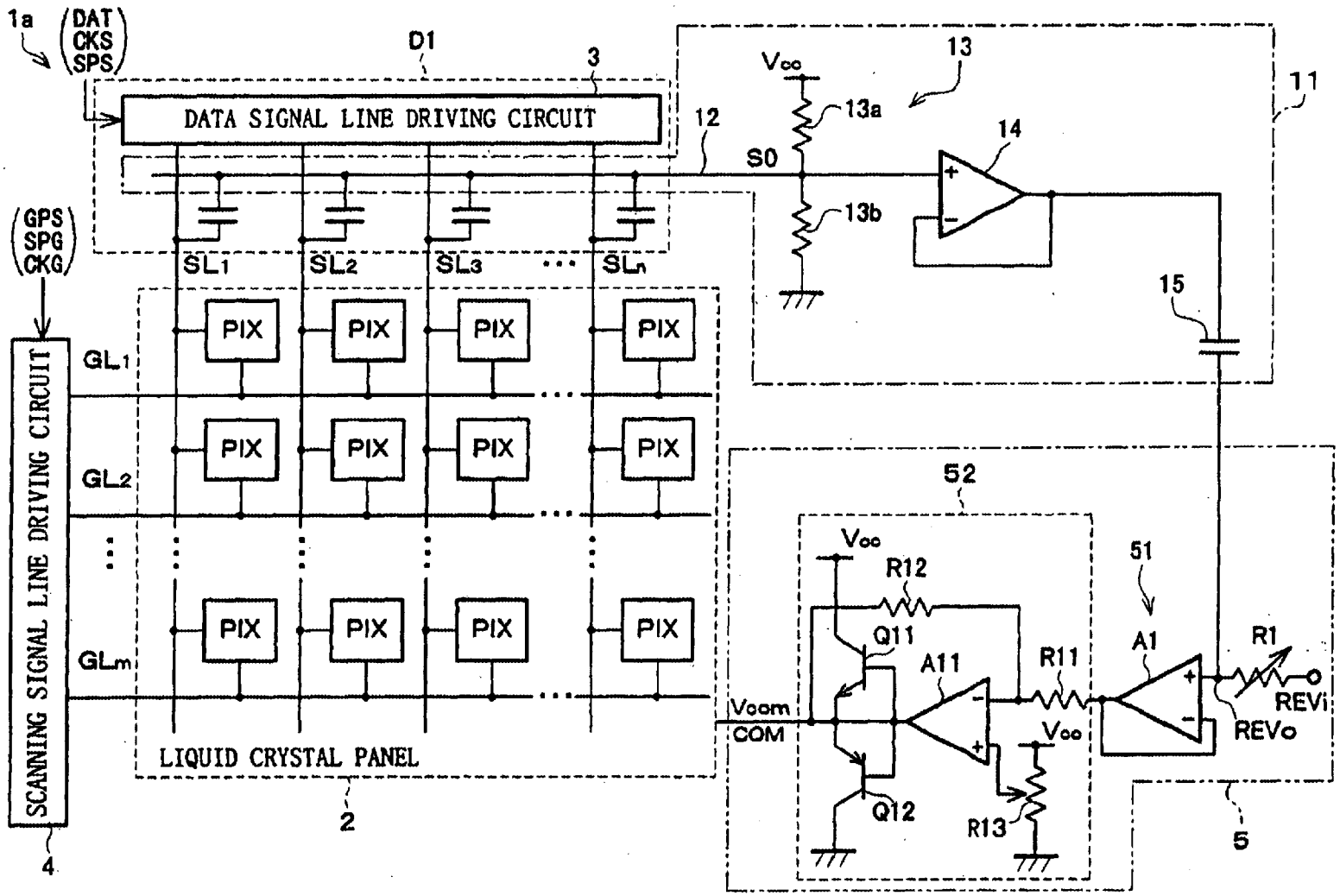
FIG. 8 illustrates a modification of the foregoing embodiment: it is a circuit diagram illustrating a principal part of an LCD device.

Incidentally, as shown in FIG. 8, the present embodiment is explained by taking as an example a case where the detection-use bus line 12 is provided on the liquid crystal panel 2 as shown in FIG. 1, but the detection-use bus line 12 may be integrated in a driver IC circuit D1 incorporating a data signal line driving circuit 3. In this arrangement, a coupling signal S0 as a sum of outputs of all the data signal lines $SL_1$ through $SL_n$ is detected at a position closer to the data signal line driving circuit 3, as compared with the case where the detection-use bus line 12 is provided on the liquid crystal panel 2. Therefore, it becomes less affected by external noise. As a result, the coupling signal S0 can be more precisely detected, and horizontal shadow can be more surely prevented.

Moreover, the LCD device 1 can be composed of a liquid crystal panel 2 without a detection-use bus line 12 and a driver IC circuit D1 in combination. Therefore, in designing an LCD device 1, a range of selection of a liquid crystal panel 2 can be broadened, as compared with a case where only the liquid crystal panel 2 having the detection-use bus line 12 is available for selection.

Figure 9:
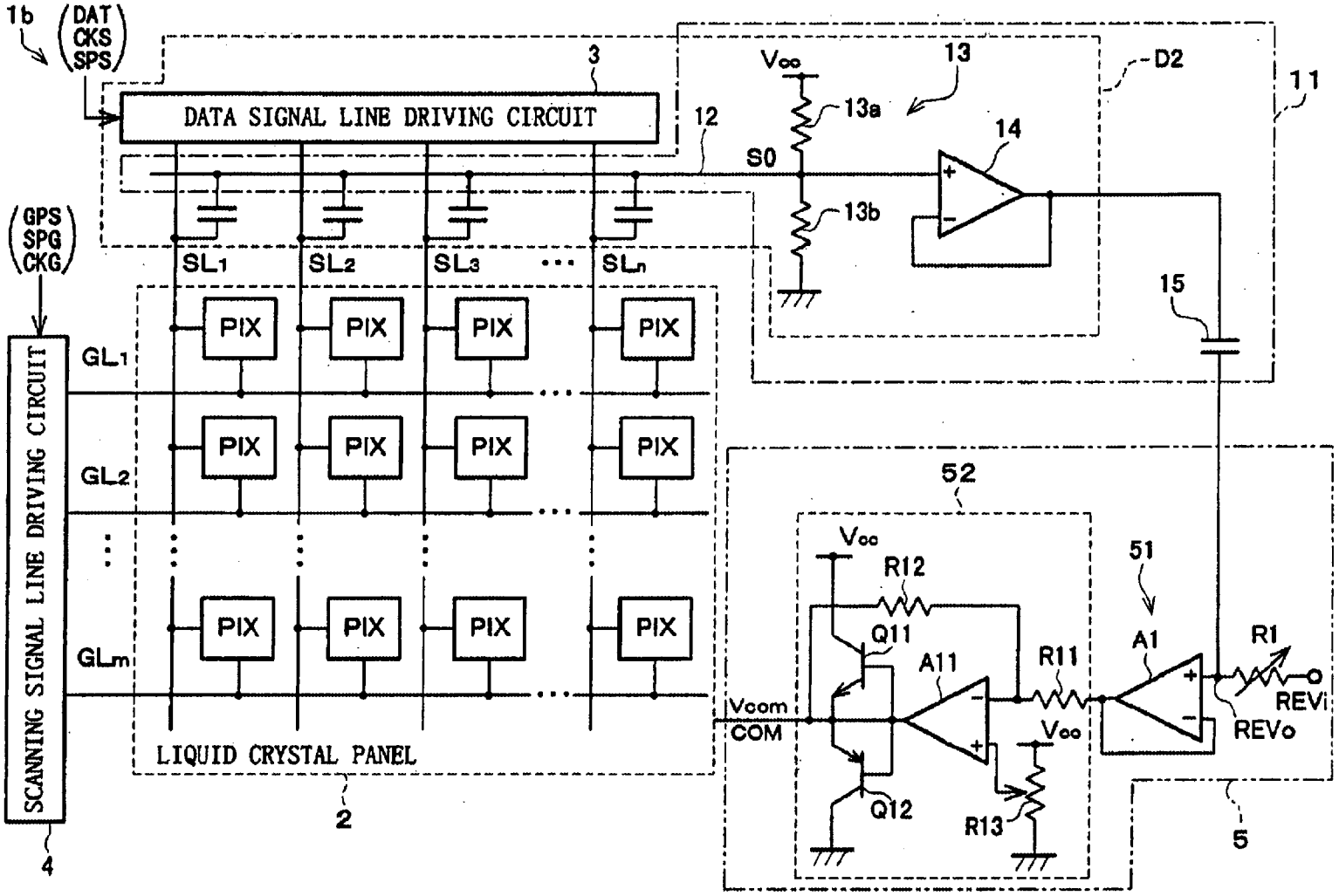
FIG. 9 illustrates another modification of the foregoing embodiment: it is a circuit diagram illustrating a principal part of an LCD device.

Furthermore, as in an LCD device 1*b* shown in FIG. 9, the driver IC circuit D2 may be equipped with, not only the detection-use bus line 12, but also a bias circuit 13 and a buffer circuit 14. This arrangement enables to simplify the manufacturing process of the LCD device 1, since a buffer circuit need not be provided outside the driver IC circuit D2. Furthermore, rear stages of the buffer circuit 14 become less affected by noises, since the buffer circuit 14 amplifies the coupling signal S0. Consequently, a more precise coupling signal S0 can be coupled with the common electrode potential Vcom, and horizontal shadow can be prevented.

Figure 10:
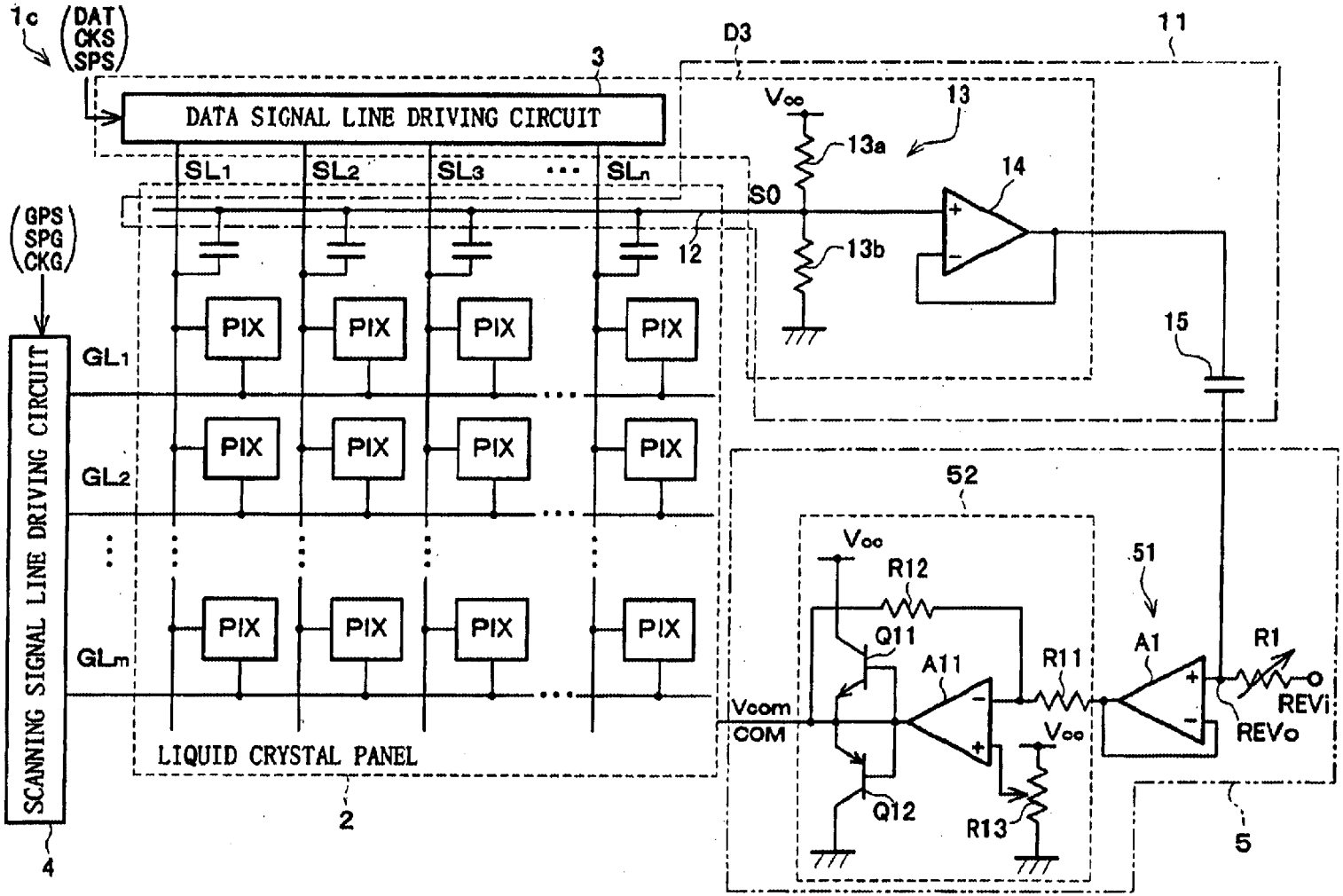
FIG. 10 illustrates still another modification of the foregoing embodiment: it is a circuit diagram illustrating a principal part of an LCD device.
Figure 11:
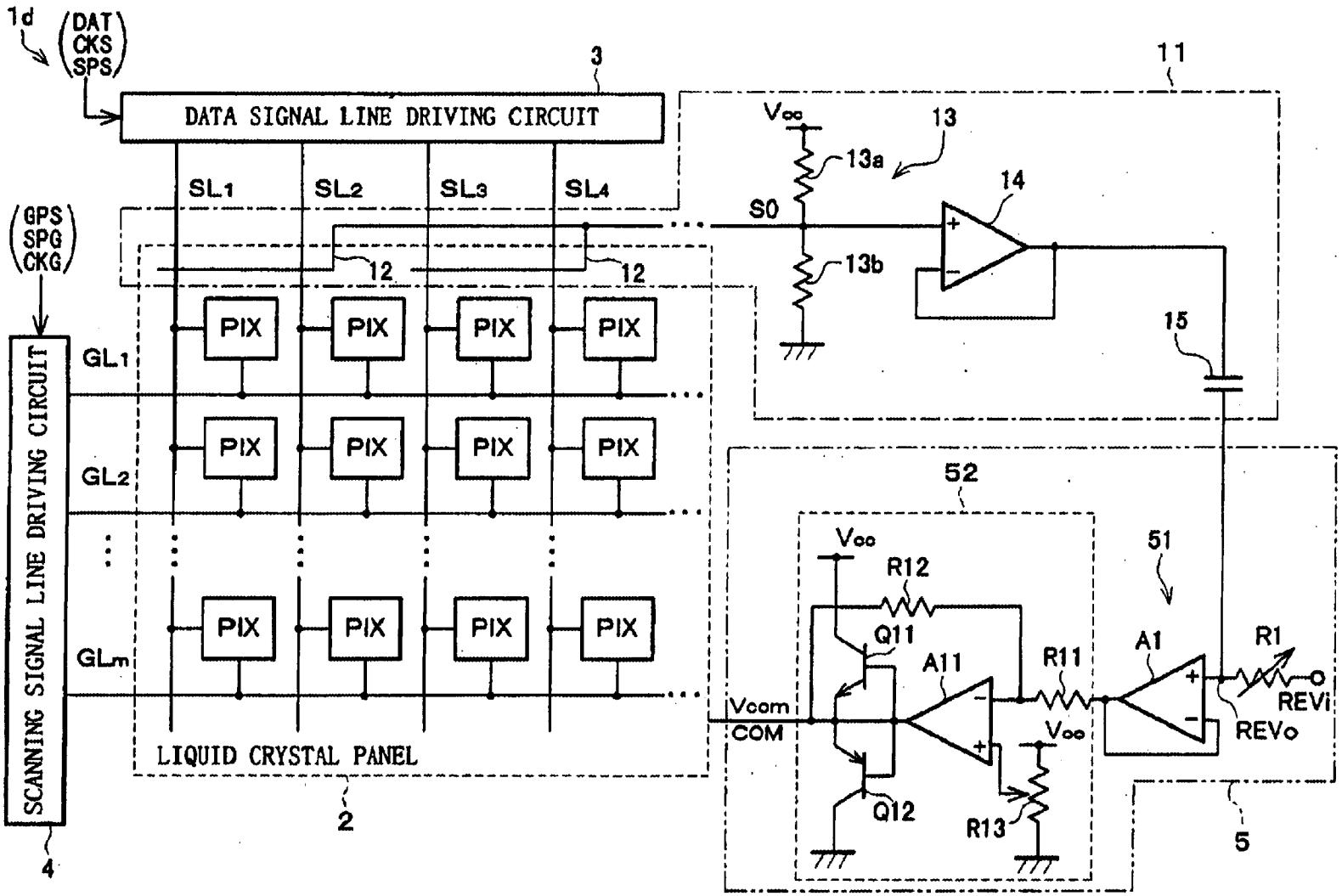
FIG. 11 illustrates still another modification of the foregoing embodiment: it is a circuit diagram illustrating a principal part of an LCD device.

Incidentally, the present embodiment is explained by taking as an example a case where the driver IC circuit D2 is provided with the detection-use bus line 12, but the detection-use bus line 12 may be provided on the liquid crystal panel 2 while the bias circuit 13 and the buffer circuit 14 may be provided in the driver IC circuit D3, as shown FIG. 10 concerning an LCD device 1*c*. This arrangement, like in the case of FIG. 9, enables to simplify the manufacturing process as compared with a case where the buffer circuit 14 or the like is provided outside, and allows a more precise coupling signal S0 to be coupled with the common electrode potential Vcom. Note that in this case the detection-use bus line 12 need be connected with the bias circuit 13 in the driver IC circuit D3, but the driver IC circuit D3 is connected with the liquid crystal panel 2 with the data signal lines $SL_1$ through $SL_n$, and is placed in the vicinity of the liquid crystal panel 2. Therefore, such connecting process of the detection-use bus line 12 does not result in a remarkable increase in the number of steps of the manufacturing process, and the noise mixed in the coupling signal S0 can be suppressed so as to be low.

Furthermore, since an output of the detection-use bus line 12 is buffered, external noise is not mixed in a signal when transferring from the output side to the input side of the buffer circuit 14. Therefore, external noise mixed in outputs of the data signal lines $SL_1$ through $SL_n$ can be reduced as well, thereby ensuring display of a picture conforming to the display signals DAT.

Incidentally, the foregoing arrangements shown in FIGS. 1, 8 through 10 are explained by taking a case where one detection-use bus line 12 is provided, but the arrangement is not limited to this. For example, like in an LCD device 1*d* shown in FIG. 11, the detection-use bus line 12 may be devised into a plurality, and a sum of waveforms detected by the plurality of the detection-use bus lines 12 may be coupled in a reversed phase with the common electrode potential Vcom. In this arrangement, a distance from an output end of the detection-use bus line 12 to the data signal line SL farthest therefrom can be shortened. Therefore, affect of resistance components of the detection-use bus line 12 can be suppressed, and further, the coupling signal S0 can be detected more precisely. Incidentally, as long as coupling of the sum of the same is ensured, the bias circuit 13 and the buffer circuit 14 may be provided so as to common to all the detection-bus lines 12, or a plurality of the same may be provided.

Furthermore, the foregoing arrangements shown in FIGS. 1, 8 through 10 are explained by taking a case where at least one detection-use bus line 12 crosses all the data signal lines $SL_1$ through $SL_n$, but if it crosses substantially all the data signal lines $SL_1$ through $SL_n$, it is possible to detect a coupling signal S0 substantially equal to that in the case where it crosses all the data signal lines. In this case, the data signal lines SL that cross the detection-use bus line 12 correspond to the data signal lines set forth in claims. However, as the data signal lines SL that do not cross any detection-use bus line 12 and do not affect the coupling signal S0 increase in number, there is a possibility that an error of the waveform of the coupling signal S0 detected by the detection-use bus line 12 from the waveform of a sum of outputs of all the data signal lines $SL_1$ through $SL_n$ increases, thereby making it impossible to prevent horizontal shadow. Therefore, the detection-use bus line 12 preferably crosses all the data signal lines $SL_1$ through $SL_n$, and if some data signal lines SL do not cross the detection-use bus line 12, the number thereof is preferably suppressed to an extent such that no horizontal shadow should be visible. This limit of the number may be obtained by experiments, or may be estimated based on an amplitude of a fluctuation of the common electrode potential Vcom that causes horizontal shadow to be viewed by eyes, an amplitude of the coupling signal S0, etc.

Incidentally, the foregoing explanation is made by taking as an example a case where a waveform of a sum of outputs of the data signal lines $SL_1$ through $SL_n$ is detected by the detection-use bus line 12 that is capacity-coupled with the respective data signal lines $SL_1$ through $SL_n$, but as long as a similar waveform is detected, for example, a current flowing through the output buffer of the data signal line driving circuit 3 may be detected. In the case where detection is executed with use of the detection-use bus line 12, however, the manufacturing process and the circuitry arrangement can be simplified as described above, since the detection-use bus line 12 is formed in another process than the process for manufacturing the LCD device 1.

[Second Embodiment]

Incidentally, the foregoing first embodiment is explained by taking a case where the coupling signal S0 indicative of a sum of outputs of the data signal lines $SL_1$ through $SL_n$ is detected with use of the detection-use bus line 12 crossing the data signal lines $SL_1$ through $SL_n$, and the detected signal is coupled in a reversed phase with the common electrode potential Vcom. On the contrary, the present embodiment will be described by taking a case, as another method for generating a coupling signal, where a waveform of a sum of outputs of the data signal lines $SL_1$ through $SL_n$ is calculated based on an input signal to the data signal line driving circuit 3.

Figure 12:
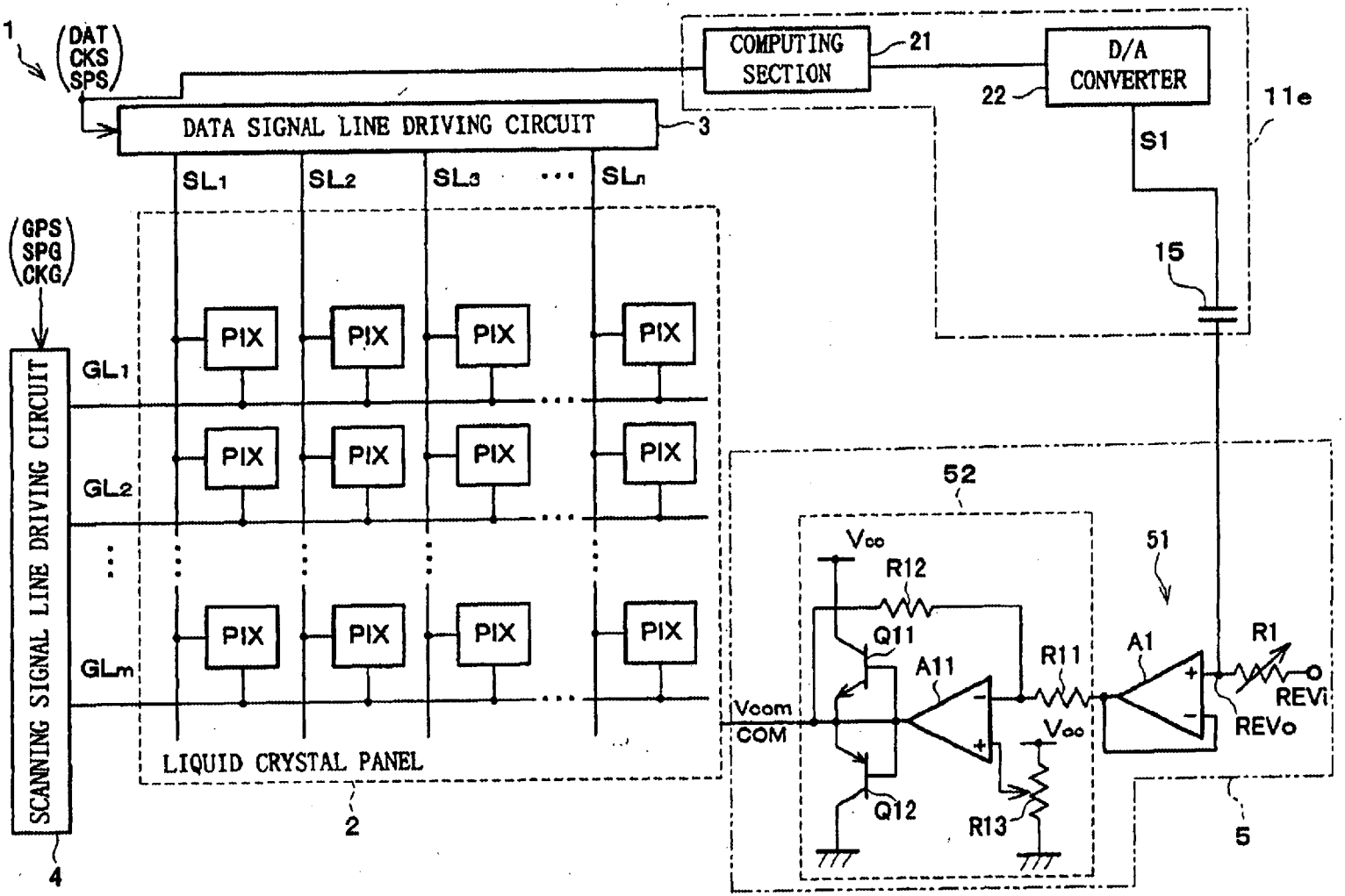
FIG. 12 illustrates another embodiment of the present invention: it is a circuit diagram illustrating a principal part of an LCD device.
Figure 13:
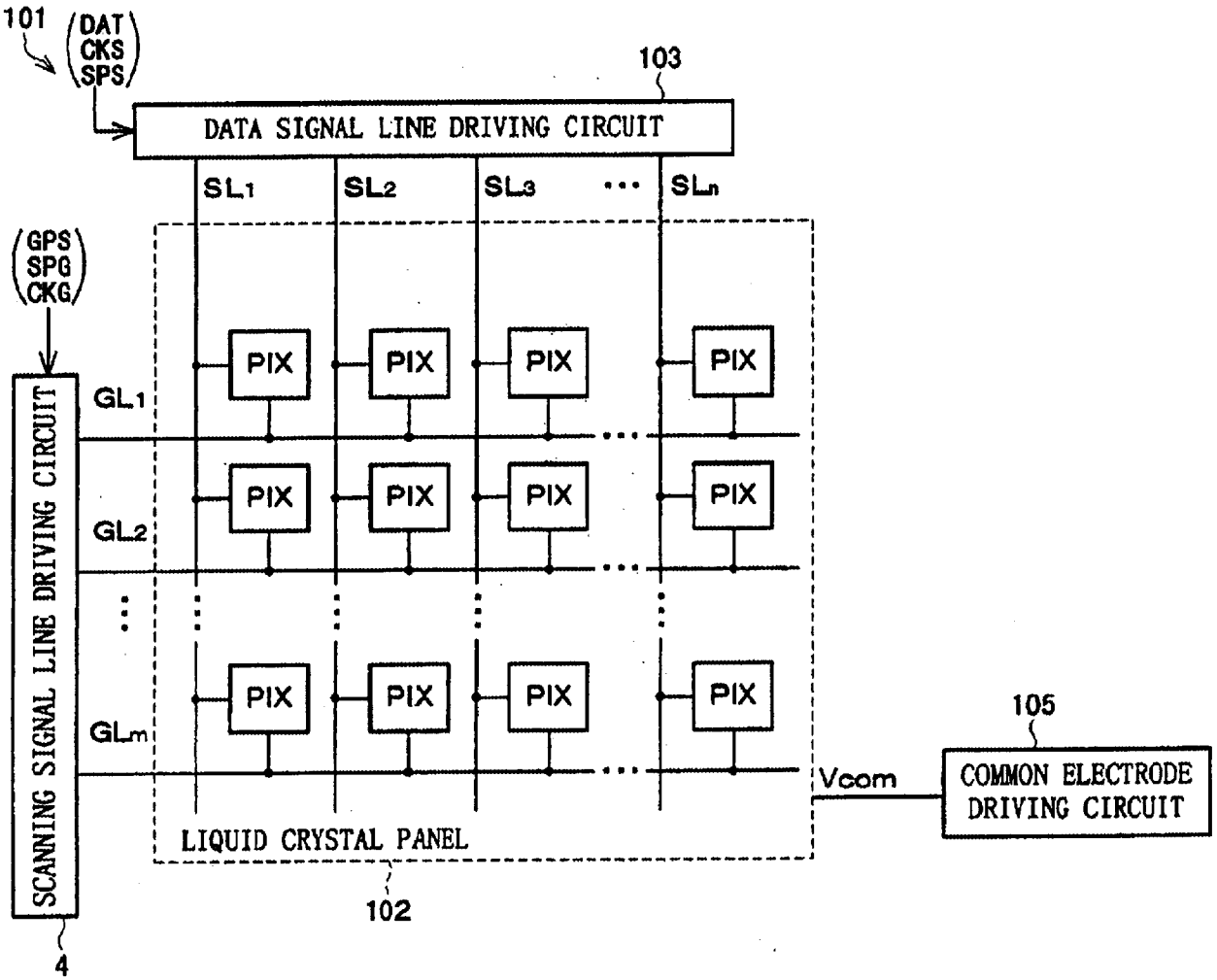
FIG. 13 illustrates prior art: it is a block diagram illustrating a principal part of an LCD device.
Figure 14:
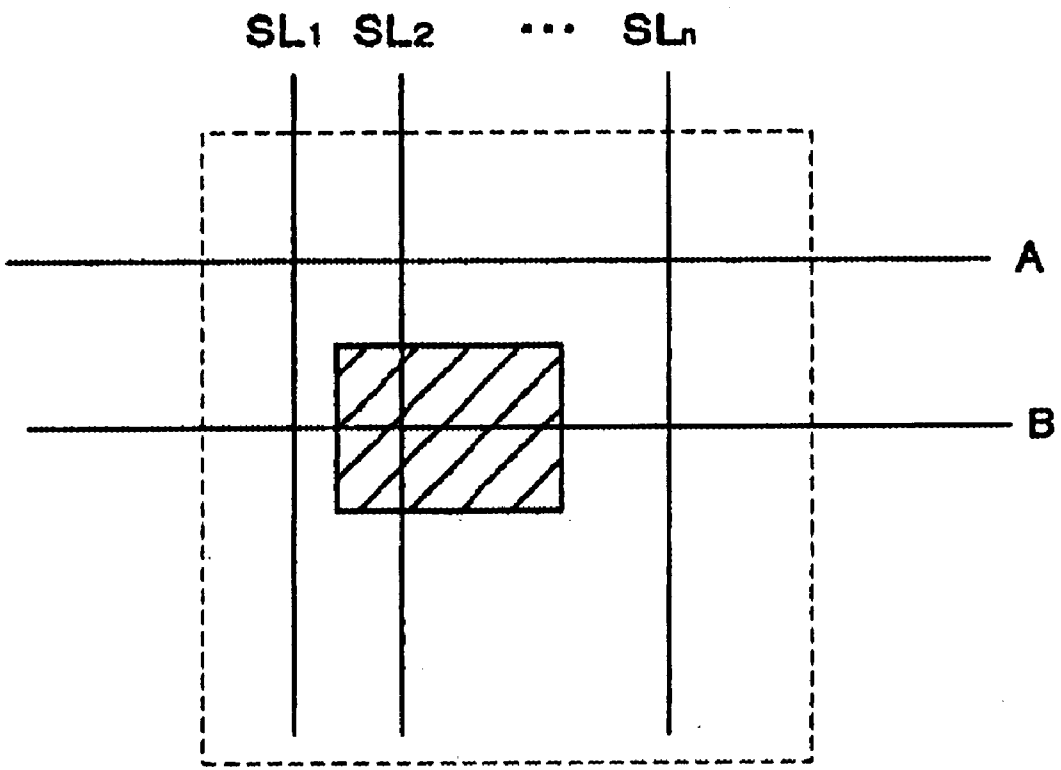
FIG. 14 is an explanatory view illustrating an example of a display pattern that tends to cause horizontal shadow in the foregoing LCD device.

More concretely, as shown in FIG. 12, an LCD device 1*e* in accordance with the present embodiment is provided with a coupling section 11*e* that includes a computing section (computing means) 21 and a D/A converter (voltage generating means) 22, in the place of the detection-use bus line 12, the bias circuit 13, and the buffer circuit 14 shown in FIG. 1.

The foregoing computing section 21 extracts display data D to be fed to the pixels from the video signals DAT, while referring to the clock signals CKS and the start signal SPS, and computes a sum of outputs of the data signal lines $SL_1$ through $SL_n$ cyclically when the data signal line driving circuit 3 changes outputs to the data signal lines $SL_1$ through $SL_n$.

The present embodiment adopts, for example, the 1H reverse driving method in that the polarity of the common electrode potential Vcom is reversed every horizontal scanning period, and therefore, the data signal line driving circuit 3 switches outputs of the data signal lines $SL_1$ through $SL_n$ every horizontal scanning period. Consequently, the computing section 21 in accordance with the present embodiment averages display data D during one horizontal scanning period, to determine an average of output data of one horizontal scanning period.

On the other hand, the D/A converter 22 converts an average of output data to an analog value. This causes a coupling signal S1 having a waveform substantially identical to that of the coupling signal S0 shown in FIG. 1, that is, a waveform equivalent to that of a sum of outputs of the data signal lines $SL_1$ through $SL_n$ to be applied to a coupling capacitor 15, so as to be coupled in a reversed phase with the common electrode potential Vcom.

Consequently, like in the first embodiment, an influence that is equivalent in magnitude and reverse in phase to that applied from the data signal lines $SL_1$ through $SL_n$ is applied to the common electrodes $T_{com}$. Therefore, as compared with the case where the common electrode potential Vcom is overshot or undershot, horizontal shadow can be prevented with low power consumption. Furthermore, like in the first embodiment, the coupling signal S1 is coupled with the signal REVi via the coupling capacitor 15 as passive element. Therefore, as compared with the case where it is coupled via an active element or the case where it is coupled with the common electrode potential Vcom, it is possible to reduce power consumption.

Incidentally, in the present embodiment, for example, a few display data D may be ignored so that a waveform of a sum of the outputs of substantially all the data signal lines $SL_1$ through $SL_n$ may be determined by computation, like in the first embodiment. In this case, the data signal lines SL whose outputs are used in the computation of waveform correspond to the data signal lines set forth in claims. However, in this case as well, it is preferably computed so that an error of the foregoing waveform from a waveform of a sum of all the data signal lines $SL_1$ through $SL_n$ should fall in a range such that horizontal shadow is not generated.

Furthermore, in the present embodiment, unlike in the first embodiment, the coupling signal S1 is determined by computation based on, not an output of the data signal line driving circuit 3, but an input thereto. Therefore, an LCD device 1*e* that does not undergo horizontal shadow can be realized by combining the liquid crystal panel 2, the data signal line driving circuit 3 that have no detection bus line 12, and the coupling section 11*e*. Consequently, a degree of freedom in designing an LCD device can be increased as compared with the case where a special liquid crystal panel 2 or a special data signal line driving circuit 3 are provided.

Furthermore, in the foregoing arrangement, the coupling signal S1 is generated according to a digital value determined by the computing section 21. Therefore, as compared with the case where the coupling signal S0 is detected with use of the detection-use bus line 12 shown in FIG. 1, a more stable coupling signal S1 immune to influences of external noises can be generated.

Here, resistances, capacitances, etc. of the scanning signal lines GL and the data signal lines SL cannot become uniform but tend to vary, due to variation in production, such as variation in manufacture conditions. Therefore, in the case where the common electrode potential Vcom is not corrected, that is, in the case where the coupling section 11 or 11*e* is not present, horizontal shadow in the liquid crystal panel 2 varies depending on the liquid crystal panel 2.

Furthermore, as in the first embodiment, in the case where the coupling signal S0 is generated with use of the detection-use bus line 12, the waveform of the coupling signal S0 varies depending on the liquid crystal panel 2, even if the output signal waveforms to the data signal lines SL are uniform between liquid crystal panels 2, since a resistance of the detection-use bus line 12, capacitances between the detection-use bus line 12 and the data signal lines SL vary as well depending on the liquid crystal panels 2. Besides, in any one of the first and second embodiments, characteristic variation of circuits composing the coupling section 11 or 11*e*, such as variation in offset voltages of the buffer circuit 14 and the D/A converter 22, also cause waveform variation of the coupling signals SO and S1 depending on liquid crystal panels 2.

Figure 16:
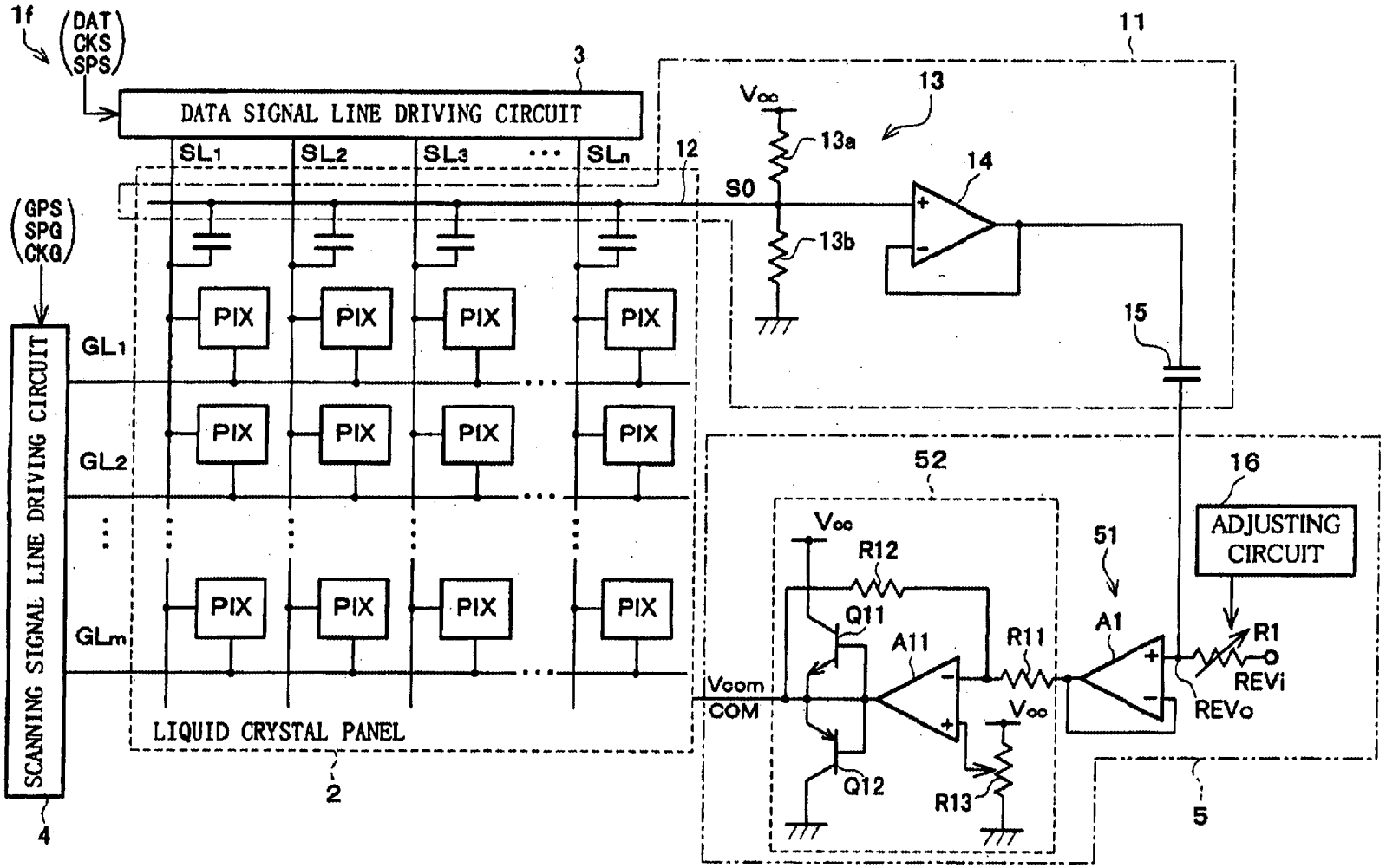
FIG. 16 illustrates a modification of the present invention: it is a circuit diagram illustrating a principal part of an LCD device.

Therefore, in the case where the foregoing variation is significant, it is preferable that an adjusting circuit 16 for adjusting an extent of coupling of the coupling signal S0 or S1 is provided, as in an LCD device 1*f* shown in FIG. 16. Incidentally, the adjusting circuit 16 can be disposed in any one of the LCD devices 1 through 1*e* of the first and second embodiments, but the following explanation is made by taking a case where the adjusting circuit 16 is provided in the LCD device 1 shown in FIG. 1.

More specifically, in the foregoing LCD device 1*f*, the coupling signal S0 (output signal of the buffer circuit 14) is coupled with the signal REVi used as a reference in the AC driving with the common electrode potential Vcom, via the coupling capacitor 15. Here, since the foregoing signal REVi is supplied through a resistor R1, an extent of coupling between the signal REVi and the output signal of the buffer circuit 14 is determined according to a time constant set according to the capacitance of the coupling capacitor 15 and the resistance of the resistor R1.

On the other hand, the resistor R1 of the foregoing a LCD device 1*f* is, for example, an electron volume, and its resistance can be adjusted by an applied voltage. Furthermore, the foregoing adjusting circuit 16 is arranged so as to adjust a voltage applied to the resistor R1 by instructions from the user, or the like. Thus, the extent of coupling between the signal REVi and the output signal of the buffer circuit 14 can be adjusted.

Consequently, even in the case where the LCD devices 1*f* too greatly vary and setting the extent of coupling uniform is not enough to prevent horizontal shadow, the adjusting circuit 16 adjust the extent of coupling according to each magnitude of horizontal shadow, thereby setting the extent of coupling such that horizontal shadow should not occur. Thus, horizontal shadow can be surely prevented in each LCD device 1*f*, even in the case where the LCD devices 1*f* greatly vary.

Incidentally, in the foregoing arrangement, the resistance of the resistor R1 is adjusted according to a signal from the adjusting circuit 16, but, for example, the resistor R1 may be composed of a semi-fixed resistor and its resistance may be manually adjusted. Alternatively, a plurality of resistors may be connected in parallel or in series, and the resistance may be adjusted by separating a part of the resistors with laser light or the like. However, in the case where, like the foregoing arrangement, the adjustment is carried out with a signal, the circuitry can be more easily designed so that the adjustment can be conducted at a finishing stage of assembly, as compared with the foregoing manual adjustment. Therefore, at the stage of a final product, the LCD device 1*f* enabling adjustment of the extent of coupling can be realized by observing effects of shadow by eyes. In this case, a product may be assembled after the extent of coupling is adjusted to some extent, and thereafter, the extent of coupling can be further adjusted at the product stage. Consequently, the extent of coupling can be easily adjusted, and the efficiency of production can be enhanced.

Furthermore, in the foregoing arrangement, the resistance of the resistor R1 is adjusted, but substantially the same effect can be achieved by adjusting the capacitance of the coupling capacitor 15 in the place of, or in addition to, the foregoing resistance. However, since the foregoing coupling capacitor 15 also functions to cut off DC components of the output signal of the buffer circuit 14 and to extract AC components, the capacitance need be set in a range such that the foregoing function can be maintained, and it cannot be set lower than a certain level. As a result, in the case where the time constant is adjusted according to only the capacitance, improvement of the degree of freedom in selecting the time constant becomes difficult. Besides, generally, adjustment of a capacitance is more difficult than adjustment of a resistance. Therefore, as in the present embodiment, to adjust the resistance R1 is preferable.

Incidentally, the first and second embodiments are thus explained by taking the case of the 1H reverse driving method, but the foregoing embodiments can be applied to the 1-dot reverse driving method as well, to prevent horizontal shadow. Horizontal shadow, however, is more visible in display patterns obtained by the 1H reverse driving method, as compared with the case by the 1-dot reverse driving method. Therefore, the foregoing embodiments are more effective when applied to the 1H reverse driving, as described in the foregoing descriptions.

Furthermore, the foregoing embodiments are described by taking a case of the AC driving with the common electrode potential Vcom, but the foregoing embodiments can be applied to the case of the DC driving with the common electrode potential Vcom, that is, the case where the common electrode potential Vcom is not reversed. In this case as well, an influence that corresponds to a fluctuation of a potential of the common electrode $T_{com}$ due to outputs of the data signal lines $SL_1$ through $SL_n$ and that is reverse in phase is given, with use of the common electrode signal (Vcom). This allows a uniform voltage waveform to the common electrode $T_{com}$ of each pixel PIX, irrespective of display patterns. Consequently, even in the case where the pixel capacitor $C_P$ charging period cannot be sufficiently secured, horizontal shadow can be prevented, like in the case of the AC driving.

As described above, an active-matrix-type liquid crystal display device (1, 1*a* through 1*f*) in accordance with the present invention comprises a plurality of scanning signal lines ($GL_1$ through $GL_m$), a plurality of data signal lines ($SL_1$ through $SL_n$) crossing the scanning signal lines, and switching elements (field effect transistors SW) each of which, in response to an instruction for conduction by a scanning signal of a scanning signal line corresponding to the switching element, connects a corresponding pixel electrode (Ts) with a corresponding data signal line, and further includes pixels ($PIX_{(i,j)}$) provided respectively corresponding to combinations of the scanning signal lines and the data signal lines, common electrodes ($T_{com}$) that are respectively provided at position opposite to the pixel electrodes with a liquid crystal layer (liquid crystal capacitor $C_L$) inserted therebetween and is fed with a common electrode signal (Vcom), a data signal line driving circuit (3) for generating an output signal to each data signal line according to display data for each pixel, a coupling section (11, 11*e*) for, according to outputs to the data signal lines, generating a coupling signal (S0, S1) in accordance with a sum of the outputs, and a common electrode driving circuit (5) for, based on the coupling signal and the driving signal as a reference used in generation of the common electrode signal, generating the common electrode signal that is given an influence such as to suppress potential turbulence caused by an output to each data signal line, by comparing the common electrode signal with a common electrode generated according to only the driving signal.

In the foregoing arrangement, switching elements in pixels corresponding to a scanning signal line selected provide conduction. This causes output signals of data signal lines corresponding to the pixels to be applied to pixel electrodes, respectively, via the switching elements, so that in pixel capacitors each being composed of a liquid crystal layer between each common electrode and each pixel electrode, charges corresponding to respective potential differences between the foregoing electrodes are stored. Then, when selection of the scanning signal line ends, the switching elements become opened, and the pixel capacitors continuously maintain the stored charges during a non-selection period, so that transmittances of the liquid crystal layer between the foregoing electrodes are kept to levels corresponding to the potential differences between the electrodes.

Here, in an active-matrix-type LCD device, a transmittance of each pixel is determined according to charges written during a selection period. Therefore, as long as a sufficiently long selection period for charging/discharging is secured, charges stored become at a level corresponding to an output to the data signal line, irrespective of a display pattern. Charging/discharging current to each pixel capacitor varies with display patterns. As a result, even in the case where uniform pulse-like voltages are applied as the foregoing common electrode signals, voltage waveforms applied to the common electrodes vary with display patterns. Therefore, in the case where a selection period is short, even the same outputs to the data signal lines tend to result in different quantities of charges depending on display patterns. As a result, transmittances at the pixels become different, thereby causing horizontal shadow.

On the other hand, in the LCD device in accordance with the present invention, based on outputs of the data signal lines, a coupling signal in accordance with a sum of the outputs to the data signal lines is generated, and the common electrode driving circuit generates a common electrode signal according to the coupling signal and the driving signal. Here, since the coupling signal varies in accordance with a sum of the outputs to the data signal lines, the common electrode driving circuit can, in generation of the common electrode signal according to both signals, generate a common electrode signal that is given an influence such as to suppress potential turbulence caused by an output to each data signal line, by comparing the common electrode with a common electrode signal generated according to only the driving signal. This provides the common electrode of each pixel with an influence that corresponds to a fluctuation of a potential of the common electrode due to the outputs of the data signal line and that has a phase opposite to that of the fluctuation. This allows a uniform voltage waveform to the common electrode of each pixel, irrespective of display patterns. This enables to prevent horizontal shadow, even in the case where making the display screen larger or providing higher definition makes it impossible to secure a sufficient pixel capacitor charging time.

Furthermore, since the common electrode driving circuit generates the common electrode signal according to the coupling signal and the driving signal, the driving power and output range of the coupling section can be suppressed, thereby resulting in that the power consumption of the LCD device can be reduced, as compared with the coupling signal is directly applied to the common electrodes.

Furthermore, the common electrode signal may be a direct current, but in the case of AC driving, the waveform of the common electrode signal becomes dulled due to the foregoing coupling, according to the outputs of the data signal lines. Therefore, the amplitude of the common electrode signal can be suppressed, as compared with the case where the common electrode signal is undershot or overshot to cause the voltage waveform applied to the common electrode to conform with the rectangular-shaped reference voltage waveform. As a result, the power consumption of the LCD device can be reduced.

Incidentally, the foregoing data signal lines may be all of the data signal lines of the LCD device or a part of the data signal lines, as long as they are data signal lines that transmit outputs that are referred to by the coupling section. In any case, it is possible to prevent horizontal shadow that occurs due to the outputs to the data signal lines that are referred to by the coupling section. In the case of a part of the data signal lines, however, fluctuations according to the display patterns occur to the voltage waveforms of the common electrodes due to the rest of the data signal lines. Therefore, in the case of a part of the data signal lines, they preferably account for substantially all of the data signal lines, or more specifically, their proportion is preferably such that fluctuations of the foregoing waveforms should not appear to eyes as horizontal shadow.

Furthermore, in the foregoing LCD device, the coupling section preferably includes a detection-use bus line (12) that crosses each of the data signal lines. Incidentally, one detection-use bus line (12) may be provided so as to cross the data signal lines. Alternatively, the data signal lines may be grouped into a plurality of groups, then, each of the groups is provided with a detection-use bus line crossing the data signal lines belonging to the group, and they may be coupled.

According to the foregoing arrangement, since the data signal line is capacity-coupled with the detection-use bus line, an output waveform of the detection-use bus line becomes a waveform in accordance with a sum of outputs of the data signal lines. Therefore, in spite of a simple arrangement with only provision of a detection-use bus line crossing the data signal lines, a waveform in accordance with the sum can be detected. Consequently, with a simple arrangement, it is possible to realize an LCD device in which horizontal shadow can be prevented.

Additionally, in the foregoing LCD device, the coupling section is preferably provided with a buffer circuit (14) for buffering a signal detected at the detection-use bus line. In this arrangement in which the output of the detection-use bus line is buffered, influences of external noises mixed in an output of the buffer circuit can be reduced. Consequently, a sum of outputs of the data signal lines can be more precisely detected, and horizontal shadow can be more surely prevented.

Furthermore, an active-matrix-type LCD device in accordance with the present invention includes a plurality of scanning signal lines, a plurality of data signal lines, pixels, common electrodes, and a data signal line driving circuit that are identical to those of the foregoing LCD device, and further includes a coupling section (11*e*) for, according to outputs to the data signal lines, generating a coupling signal in accordance with a sum of the outputs in a switching cycle of the outputs, and a common electrode driving circuit (5) for, based on the coupling signal (S1) and the driving signal as a reference used in generation of the common electrode signal, generating the common electrode signal that is given an influence such as to suppress potential turbulence caused by an output to each data signal line, by comparing the common electrode signal with a common electrode generated according to only the driving signal. Incidentally, like in the aforementioned arrangement, the foregoing data signal lines may be all the data signal lines of the LCD device, or alternatively, they are a part of all the data signal lines.

In the foregoing arrangement, the coupling section generates a coupling signal as a sum of the outputs to the data signal lines based on display data for generating outputs to the data signal lines, and the common electrode driving circuit generates a common electrode signal based on the coupling signal and the driving signal. As a result, like in the case where it is based on the outputs of the data signal lines, this allows the common electrode signal to have an influence that corresponds to a fluctuation of a potential of the common electrode due to the outputs of the data signal line and that has a phase opposite to that of the fluctuation, with electric power lower than that in the case where the foregoing coupling signal is directly applied to the common electrodes. Therefore, even in the case where a sufficient time for charging the pixel capacitors cannot be secured, an LCD device that does not undergo horizontal shadow and consumes less electric power can be realized.

Furthermore, since the sum of the outputs is detected not based on the outputs of the data signal lines but based on the display data, a member for detecting outputs, such as a bus line, need not be provided from the data signal line driving circuit to the liquid crystal panel having pixels. Therefore, horizontal shadow can be prevented without changing the data signal line driving circuit and the liquid crystal panel.

Furthermore, in the foregoing LCD device, the foregoing coupling section is preferably provided with a computing circuit (computing section 21) for calculating an average of output data by the switching cycles of the output signals, and a voltage generating circuit (D/A converter 22) for generating, as the foregoing coupling signal, a signal of a voltage according to the foregoing average of output data.

In the foregoing arrangement, the computing circuit calculates an average of output data, and the voltage generating circuit generates a coupling signal based on the average of output data. Therefore, a stable coupling signal immune to influences of external noises can be generated.

Furthermore, in each of the foregoing LCD devices (1, 1*a* through 1*f*), the coupling section includes a coupling circuit (coupling capacitor 15) for coupling the foregoing coupling signal with a driving signal, and the foregoing common electrode driving circuit preferably amplifies the driving signal coupled with the coupling signal so as to generate the common electrode signal.

In the foregoing arrangement, the driving signal is coupled with the coupling signal by the coupling circuit and thereafter amplified by the common electrode driving circuit, thereby becoming the common electrode signal. Consequently, in spite of the simple arrangement such that a coupling circuit is added to an arrangement for amplifying the driving signal so as to generating a common electrode signal, the common electrode signal generated with reference to the driving signal can be controlled according to the coupling signal.

Furthermore, in the LCD device having the foregoing coupling circuit, the coupling circuit is preferably a coupling capacitor. In this arrangement, since the coupling signal is coupled by the coupling capacitor as a passive element, power consumption by the LCD device can be suppressed as compared with the case where the coupling signal is coupled by the coupling capacitor as an active element.

Furthermore, the foregoing arrangement may be further arranged so that the foregoing driving signal is applied to the common electrode driving circuit via a resistor (R1), while a time constant according to the coupling capacitor and the resistor is set so that an extent of coupling between the coupling signal and the driving signal should have a predetermined value.

In the foregoing arrangement, since the extent of coupling is set according to the time constant according to the coupling capacitor and the resistor, the common electrode signal can be controlled according to the coupling signal, in spite of the simple arrangement in which a high-performance operational amplifying element is not employed.

Here, resistances, capacitances, etc. of the scanning signal lines and the data signal lines cannot become uniform but tend to vary, due to variation in production, such as variation in manufacture conditions. Besides, sensitivity of the coupling section also varies due to variation of circuit constants of the coupling section such as variation of the resistances of the detection-use bus line, variation of capacitances between the detection-use bus line and the data signal lines. As a result, the degree of shadow generated tends to vary from an LCD device to an LCD device. Therefore, in the case where the extent of coupling is uniformly set, shadow cannot be prevented in the case where the variation among the LCD devices is great.

Therefore, in the case where variation is great thereby causing shadow when the extent of coupling is set uniform, the foregoing arrangement preferably is further arranged so as to further include an adjusting circuit (16) that adjusts at least either a resistance of the foregoing resistor or a capacitance of the coupling capacitor.

In the foregoing arrangement, the adjusting circuit adjusts at least either the resistance of the resistor or a capacitance of the coupling capacitor, so as to adjust the time constant according to the coupling capacitor and the resistor. This enables each LCD device to adjust the extent of coupling according to a magnitude of shadow generated therein, so that the shadow can be prevented. Consequently, it is possible to realize an LCD device in which shadow can be prevented, even with great variation between LCD devices.

Furthermore, the foregoing resistor and coupling capacitor may be such that the resistance and capacitance manually adjustable, or alternatively they may be members whose resistance and capacitance are adjustable in response to signals given from outside, for example, electronic volumes. In the latter case, the extent of coupling can be finely adjusted in a finished state of assembly, watching influences of shadow with eyes. Therefore, this enables not only to reduce steps in the adjusting process thereby enhancing the efficiency of production, but also to prevent shadow more surely.

Furthermore, in the foregoing LCD device having the coupling capacitor and resistor, the driving signal is a signal for AC driving of the common electrode signal, and the foregoing time constant may be set so that dullness of a waveform of the common electrode signal with respect to the foregoing driving signal varies in accordance with the level of the coupling signal.

In the foregoing arrangement, the dullness of the waveform of the common electrode signal varies in accordance with the level of the coupling signal. Therefore, as compared with the case where the common electrode signal is undershot or overshot so that a voltage waveform applied to the common electrode should conform with a rectangular-shaped reference voltage waveform, an amplitude of the common electrode signal can be made smaller. Furthermore, response speeds of the coupling section and the common electrode driving circuit can be set lower, as compared with the case where the common electrode signal is undershot or overshot. Consequently, horizontal shadow can be prevented with smaller power consumption, as compared with the foregoing case. Furthermore, since the response speed may be relatively lower, horizontal shadow can be prevented in a high-definition active-matrix-type LCD device having a larger display screen, even with a simple arrangement including a resistor and a coupling capacitor.

On the other hand, a data signal line driving circuit (driver IC circuit D1, D2) in accordance with the present invention is a data signal line driving circuit provided with an output circuit (data signal line driving circuit 3) that is employed in an LCD device including a plurality of scanning signal lines, a plurality of data signal lines, pixels, and common electrodes that are identical to those of the foregoing LCD device, and that outputs output signals to the data signal lines via output signal lines corresponding to the data signal lines, respectively, and further, the data signal line driving circuit is provided with a detection-use bus line laid crossing each of the output signal lines. Incidentally, the foregoing data signal lines are all the data signal lines of the LCD device, or they may be a part of all the data signal lines.

The foregoing data signal line driving circuit is arranged so that the a waveform in accordance with a sum of respective outputs to the data signal lines can be outputted from the detection-use bus line. Besides, since the detection-use bus line is provided in the data signal line driving circuit, a waveform hardly affected by external noises and providing high definition can be outputted. Consequently, horizontal shadow can be surely prevented only by coupling the foregoing waveform in a reversed phase with the common electrode signal. Therefore, a data signal line driving circuit suitable for preventing horizontal shadow can be realized.

Furthermore, the foregoing data signal line driving circuit arranged as above is preferably provided with a buffer circuit for buffering an output of the detection-use bus line. In this arrangement in which the buffer circuit is provided, external noises mixed in the output of the buffer circuit can be reduced. Consequently, a data signal line driving circuit suitable for preventing horizontal shadow can be realized.

On the other hand, a method of driving an active-matrix LCD device in accordance with the present invention is a method for driving an active-matrix-type liquid crystal display device that includes (i) a plurality of scanning signal lines, (ii) a plurality of data signal lines crossing the scanning signal lines, (iii) switching elements each of which, in response to an instruction for conduction by a scanning signal of a scanning signal line corresponding to the switching element, connects a corresponding pixel electrode with a corresponding data signal line, (iv) pixels provided respectively corresponding to combinations of the scanning signal lines and the data signal lines, and (v) common electrodes that are respectively provided at position opposite to the pixel electrodes with a liquid crystal layer inserted therebetween and is actuated by AC driving with a common electrode signal, and the method is characterized in that the common electrode signal is dulled as a potential difference between the common electrode signal and a sum of outputs of the data signal lines becomes smaller by the switching cycles of the output signals. Incidentally, the data signal lines taken into consideration in dulling the voltage waveform may be all the data signal lines of the LCD device, or may be a part of all the data signal lines.

The foregoing arrangement causes the waveform dullness of the common electrode signal to become smaller when signals that are in a phase opposite to that of the common electrode signal and that have great amplitudes are outputted to the data signal lines, for example, upon black display. On the other hand, the foregoing arrangement causes the waveform dullness to become greater when signals that are in the same phase and that have great amplitudes are outputted to the data signal lines, for example, upon white display. Therefore, like in the aforementioned LCD device, an influence that corresponds to a fluctuation of a potential of the common electrode due to outputs of the data signal lines and that is reverse in phase is given, with use of the common electrode signal. This allows a voltage waveform uniformly dulled to be applied to the common electrode of each pixel, irrespective of a display pattern. This enables to prevent horizontal shadow, even in the case where making the display screen larger or providing higher definition makes it impossible to secure a sufficient pixel capacitor charging time.

Furthermore, by the foregoing driving method in which the waveform is dulled according to the outputs to the data signal lines, the amplitude of the common electrode signal can be suppressed, as compared with the case where the common electrode signal is undershot or overshot to cause the voltage waveform applied to each common electrode to conform with the rectangular-shaped reference voltage waveform. As a result, the power consumption of the LCD device can be reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An active-matrix-type liquid crystal display device, comprising:

a plurality of scanning signal lines;

a plurality of data signal lines crossing said scanning signal lines;

pixels each including a switching element that connects a pixel electrode with a corresponding data signal line when a scanning signal of a corresponding scanning signal line instructs conduction, said pixels being provided so as to respectively correspond to combinations of said scanning signal lines and said data signal lines;

common electrodes provided at positions vis-a-vis said pixel electrodes, a liquid crystal layer being provided between said common electrodes and said pixel electrodes, a common electrode signal being applied to said common electrodes;

data signal line driving means for generating an output signal to each data signal line, based on display data of each pixel;

a coupling section for, based on the outputs to said data signal lines, generating a coupling signal in accordance with a sum of the outputs, said coupling section including a coupling capacitor that couples a driving signal with the coupling signal;

common electrode driving means for, based on the coupling signal and the driving signal as a reference used in generation of the common electrode signal, generating the common electrode signal that is given an influence such as to suppress potential turbulence caused by an output to each data signal line, by comparing the common electrode signal with a common electrode signal generated according to only the driving signal; and wherein said common electrode driving means amplifies the driving signal coupled with the coupling signal, so as to generate the common electrode signal.

2. The liquid crystal display device as set forth in claim 1, wherein the driving signal is a signal for AC driving of the common electrode signal.

3. The liquid crystal display device as set forth in claim 1, wherein said coupling section includes a detection-use bus line that is disposed so as to cross said data signal lines.

4. The liquid crystal display device as set forth in claim 3, wherein said coupling section includes buffer means for buffering a signal detected by said detection-use bus line.

5. The liquid crystal display device as set forth in claim 1, wherein:

the driving signal is applied to said common electrode driving means via a resistor; and a time constant according to said coupling capacitor and said resistor is set so that an extent of coupling between the coupling signal and the driving signal should have a predetermined value.

6. The liquid crystal display device as set forth in claim 5, further comprising adjusting means for adjusting at least either a resistance of said resistor or a capacitance of said coupling capacitor.

7. The liquid crystal display device as set forth in claim 6, wherein said adjusting means adjusts the resistance of said resistor.

8. The liquid crystal display device as set forth in claim 5, wherein:

the driving signal is a signal for AC driving of the common electrode signal; and the time constant is set so that dullness of a waveform of the common electrode signal with respect to the driving signal should vary in accordance with a level of the coupling signal.

9. An active-matrix-type liquid crystal display device, comprising:

a plurality of scanning signal lines;

a plurality of data signal lines crossing said scanning signal lines;

pixels each including a switching element that connects a pixel electrode with a corresponding data signal line when a scanning signal of a corresponding scanning signal line instructs conduction, said pixels being provided so as to respectively correspond to combinations of said scanning signal lines and said data signal lines;

common electrodes provided at positions vis-a-vis said pixel electrodes, a liquid crystal layer being provided between said common electrodes and said pixel electrodes, a common electrode signal being applied to said common electrodes;

data signal line driving means for generating an output signal to each data signal line, based on display data of each pixel;

a detection-use bus line provided so as to cross each of said data signal lines;

a resistor that is supplied via its first end with a driving signal as a reference used in generation of the common electrode signal;

an amplifying circuit that amplifies a signal at a second end of said resistor and generates the common electrode signal; and a coupling capacitor provided between said detection-use bus line and the second end of said resistor, for coupling a signal detected at the second end of the resistor with a signal detected at the detection-use bus line, in a polarity opposite to that of potential fluctuations at said common electrodes that are caused by outputs to said data signal lines, upon application of the common electrode signal to said common electrodes.

10. A data signal line driving circuit used in a liquid crystal display device, said liquid crystal display device including:

a plurality of scanning signal lines, a plurality of data signal lines crossing said scanning signal lines, switching elements each of which, in response to an instruction for conduction by a scanning signal of a scanning signal line corresponding to said switching element, connects a corresponding pixel electrode with a corresponding data signal line;

pixels provided respectively corresponding to combinations of said scanning signal lines and said data signal lines; and common electrodes that are respectively provided at position opposite to said pixel electrodes with a liquid crystal layer inserted therebetween and is fed with a common electrode signal, said data signal line driving circuit comprising:

an output circuit for outputting output signals to said data signal lines via output signal lines respectively corresponding to said data signal lines; and a detection-use bus line provided so as to cross each of said output signal lines, for detecting a signal that is in accordance with a sum of output signals for the respective output signal lines.

11. The data signal line driving circuit as set forth in claim 10, further comprising buffer means for buffering an output of said detection-use bus line.

12. The data signal line driving circuit as set forth in claim 11, wherein the buffer means is integrated in a driver IC circuit incorporating said data signal line driving circuit.

13. The data signal line driving circuit as set forth in claim 11, wherein the detection-use bus line and the buffer means are integrated in a driver IC circuit incorporating said data signal line driving circuit.

14. The data signal line driving circuit as set forth in claim 10, wherein the detection-use bus line is integrated in a driver IC circuit incorporating said data signal line driving circuit.

15. An active-matrix-type liquid crystal display device, comprising:

a plurality of scanning signal lines;

a plurality of data signal lines crossing said scanning signal lines;

pixels each including a switching element that connects a pixel electrode with a corresponding data signal line when a scanning signal of a corresponding scanning signal line instructs conduction, said pixels being provided so as to respectively correspond to combinations of said scanning signal lines and said data signal lines;

common electrodes provided at positions vis-a-vis said pixel electrodes, a liquid crystal layer being provided between said common electrodes and said pixel electrodes, a common electrode signal being applied to said common electrodes;

data signal line driving means for generating an output signal to each data signal line, based on display data of each pixel;

a coupling section for generating a coupling signal in accordance with a sum of the outputs of said data signal lines by the switching cycles of the outputs, according to the display data, said coupling section including a coupling capacitor that couples a driving signal with the coupling signal;

a common electrode driving means for, based on the coupling signal and the driving signal as a reference used in generation of the common electrode signal, generating the common electrode signal that is given an influence such as to suppress potential turbulence caused by an output to each data signal line, by comparing the common electrode signal with a common electrode signal generated according to only the driving signal;

wherein said common electrode driving means amplifies the driving signal coupled with the coupling signal, so as to generate the common electrode signal;

wherein the driving signal is applied to said common electrode driving means via a resistor and a time constant according to said coupling capacitor and said resistor is set so that an extent of coupling between the coupling signal and the driving signal should have a predetermined value; and adjusting means for adjusting at least either a resistance of said resistor or a capacitance of said coupling capacitor.

16. The liquid crystal display device as set forth in claim 15, wherein the driving signal is a signal for AC driving of the common electrode signal.

17. The liquid crystal display device as set forth in claim 15, wherein said coupling section includes:

computing means for calculating an average of output data by the switching cycles of the output signals; and voltage generating means for generating, as the coupling signal, a signal of a voltage according to the average of output data.

18. The liquid crystal display device as set forth in claim 17, wherein said voltage generating means is a D/A converter for converting a digital value outputted by said computing means into an analog value.

19. The liquid crystal display device as set forth in claim 15, wherein said adjusting means adjusts the resistance of said resistor.

20. The liquid crystal display device as set forth in claim 15, wherein:

the driving signal is a signal for AC driving of the common electrode signal; and the time constant is set so that dullness of a waveform of the common electrode signal with respect to the driving signal should vary in accordance with a level of the coupling signal.

21. An active-matrix-type liquid crystal display device, comprising:

a plurality of scanning signal lines;

a plurality of data signal lines crossing said scanning signal lines;

pixels each including a switching element connecting a pixel electrode with a corresponding data signal line when a scanning signal of a corresponding scanning signal line instructs conduction, said pixels being provided corresponding to combinations of said scanning signal lines and said data signal lines;

common electrodes provided at positions vis-a-vis said pixel electrodes, a liquid crystal layer being provided between said common electrodes and said pixel electrodes, a common electrode signal being applied to said common electrodes;

data signal line driving means for generating an output signal to each data signal line, based on display data of each pixel;

a computing circuit for calculating an average of output data by the switching cycles of the output signals;

a voltage generating circuit for generating a signal of a voltage according to the average of output data;

a resistor that is supplied, via its first end, with a driving signal as a reference used in generation of the common electrode signal;

an amplifying circuit that amplifies a signal at a second end of said resistor and generates the common electrode signal; and a coupling capacitor provided between said voltage generating circuit and the second end of said resistor, for coupling a signal detected at the second end of the resistor with a signal of said voltage generating circuit, in a polarity opposite to that of potential fluctuations at said common electrodes that are caused by outputs to said data signal lines, upon application of the common electrode signal to said common electrodes.

22. A method for driving an active-matrix-type liquid crystal display device, the active-matrix-type liquid crystal display device including:

a plurality of scanning signal lines, a plurality of data signal lines crossing said scanning signal lines, switching elements each of which, in response to an instruction for conduction by a scanning signal of a scanning signal line corresponding to said switching element, connects a corresponding pixel electrode with a corresponding data signal line;

pixels provided so as to respectively correspond to combinations of said scanning signal lines and said data signal lines; and common electrodes that are respectively provided at position opposite to said pixel electrodes with a liquid crystal layer inserted therebetween and is fed with a common electrode signal, wherein the common electrode signal is dulled as a potential difference between the common electrode signal and a sum of outputs of the data signal lines becomes smaller by the switching cycles of the output signals.

* * * * *